US009206690B2

(12) United States Patent
Niwata et al.

(10) Patent No.: US 9,206,690 B2
(45) Date of Patent: Dec. 8, 2015

(54) VARIABLE DISPLACEMENT PUMP

(75) Inventors: Dai Niwata, Atsugi (JP); Koji Saga, Ebina (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 802 days.

(21) Appl. No.: 13/444,428

(22) Filed: Apr. 11, 2012

(65) Prior Publication Data

US 2013/0028770 A1 Jan. 31, 2013

(30) Foreign Application Priority Data

Jul. 26, 2011 (JP) ..... 2011-162816

(51) Int. Cl.

| | |
|---|---|
| ***F04C 14/22*** | (2006.01) |
| ***F01C 21/10*** | (2006.01) |
| ***F01C 21/08*** | (2006.01) |
| ***F04C 2/344*** | (2006.01) |

(52) U.S. Cl.

CPC ..... *F01C 21/108* (2013.01); *F01C 21/0845* (2013.01); *F04C 2/3442* (2013.01); *F04C 14/226* (2013.01)

(58) Field of Classification Search

CPC ..... F01C 21/08; F01C 21/0836–21/0863; F01C 21/108; F04C 2/3442; F04C 14/22–14/226

USPC ..... 418/24–27, 30, 259, 266–268, 79; 417/220, 310

See application file for complete search history.

(56) References Cited

U.S. PATENT DOCUMENTS

| | | | | |
|---|---|---|---|---|
| 3,824,041 | A * | 7/1974 | Rystrom | F04C 15/062 417/310 |
| 4,531,898 | A * | 7/1985 | Ideta | F04C 14/226 417/220 |
| 5,921,274 | A * | 7/1999 | Schuller et al. | F04B 49/035 137/469 |
| 6,068,461 | A * | 5/2000 | Haga et al. | F04C 15/0049 418/180 |
| 6,155,797 | A * | 12/2000 | Kazuyoshi | F04C 14/226 417/220 |
| 7,682,135 | B2 * | 3/2010 | Ueki et al. | F04C 14/226 417/220 |
| 7,862,306 | B2 * | 1/2011 | Staley et al. | F04C 14/226 417/219 |
| 2008/0187446 | A1 * | 8/2008 | Staley et al. | F04C 14/226 417/220 |
| 2008/0308062 | A1 * | 12/2008 | Morita et al. | F04C 14/226 123/196 R |
| 2010/0226799 | A1 * | 9/2010 | Watanabe et al. | F04C 14/223 417/364 |

FOREIGN PATENT DOCUMENTS

JP 2008-309049 A 12/2008

* cited by examiner

*Primary Examiner* — Devon Kramer
*Assistant Examiner* — Joseph Herrmann
(74) *Attorney, Agent, or Firm* — Crowell & Moring LLP

(57) ABSTRACT

A variable displacement pump includes: side walls provided on both sides of the cam ring in an axial direction; and an introduction passage which is formed on one of the separation walls across which the hydraulic chambers pass when the hydraulic chambers are moved from the suction portion to the discharge portion, which is arranged to shut off a connection between one of the hydraulic chambers and the control hydraulic chamber by an axial end surface of the cam ring when the cam ring is in a maximum eccentric state, and which is arranged to connect the one of the hydraulic chambers and the control hydraulic chamber by a movement of the cam ring in the direction to decrease the eccentric amount of the cam ring, and thereby to introduce the discharge pressure within the control hydraulic chamber to the one of the hydraulic chambers.

17 Claims, 14 Drawing Sheets

VARIABLE DISPLACEMENT PUMP

BACKGROUND OF THE INVENTION

This invention relates to a variable displacement pump arranged to supply a hydraulic fluid to sliding portions and so on of an internal combustion engine for a vehicle.

U.S. Patent Application Publication No. 2008/308062 (corresponding to Japanese Patent Application Publication No. 2008-309049) discloses a conventional variable displacement oil pump which is employed as a hydraulic pressure source of an internal combustion engine and so on of a vehicle. This conventional variable displacement oil pump controls an eccentric amount of a cam ring constantly urged by a spring in an eccentric direction with respect to a center of a rotation of a rotor, based on a discharge pressure introduced into a control hydraulic chamber separated between a housing and a cam ring. With this, this variable displacement oil pump varies the discharge amount so as to attain the energy saving by decreasing the driving torque of the pump.

SUMMARY OF THE INVENTION

However, in recent years, it is desired to attain the increase of the discharge amount and the size reduction by driving the conventional variable displacement oil pump at a high speed higher than the engine speed by a balancer apparatus and so on of the internal combustion engine.

However, in a case where the conventional variable displacement oil pump is driven at the high speed as described above, the suction amount is not followed (caught up), so that the cavitation is generated. With this, the noise, the erosion and so on may be caused.

It is, therefore, an object of the present invention to provide a variable displacement oil pump arranged to suppress adverse effects due to a cavitation even at high rotational speed.

According to one aspect of the present invention, a variable displacement pump comprises: a rotor driven to rotate; a plurality of vanes which are disposed at an outer circumference portion of the rotor, and each of which is arranged to be moved in a radially inward direction and in a radially outward direction of the rotor; a cam ring which receives the rotor and the vanes therein, which separates a plurality of hydraulic chambers with the rotor and the vanes, and which is arranged to be moved to vary an eccentric amount of a center of an inner circumference surface of the cam ring with respect to a center of a rotation of the rotor, and thereby to increase or decrease volumes of the hydraulic chambers at the rotation of the rotor; side walls provided on both sides of the cam ring in an axial direction, one of the side walls including a suction portion and a discharge portion, the suction portion being opened to the hydraulic chambers whose the volumes are increased when the cam ring is moved in a direction to increase the eccentric amount of the cam ring, and the discharge portion being formed by being separated from the suction portion, in a direction of the rotation of the rotor by separation walls each having a circumferential width greater than a circumferential width of the hydraulic chambers, and which is opened to the hydraulic chambers whose the volumes are decreased when the cam ring is moved in the direction to increase the eccentric amount of the cam ring; an urging member arranged to urge the cam ring in the direction to increase the eccentric amount of the cam ring; a control hydraulic chamber arranged to receive a discharge pressure, and thereby to urge the cam ring by the discharge pressure in a direction to decrease the eccentric amount of the cam ring, against the urging force of the urging member; and an introduction passage which is formed on one of the separation walls across which the hydraulic chambers pass when the hydraulic chambers are moved from the suction portion to the discharge portion, which is arranged to shut off a connection between one of the hydraulic chambers and the control hydraulic chamber by an axial end surface of the cam ring when the cam ring is in a maximum eccentric state, and which is arranged to connect the one of the hydraulic chambers and the control hydraulic chamber by a movement of the cam ring in the direction to decrease the eccentric amount of the cam ring, and thereby to introduce the discharge pressure within the control hydraulic chamber to the one of the hydraulic chambers.

According to another aspect of the invention, a variable displacement pump comprises: a rotor driven to rotate; a plurality of vanes which are disposed at an outer circumference portion of the rotor, and each of which is arranged to be moved in a radially inward direction and in a radially outward direction of the rotor; a cam ring which receives the rotor and the vanes therein, which separates a plurality of hydraulic chambers with the rotor and the vanes, and which is arranged to be moved to vary an eccentric amount of a center of an inner circumference surface of the cam ring with respect to a center of a rotation of the rotor, and thereby to increase or decrease volumes of the hydraulic chambers at the rotation of the rotor; side walls provided on both sides of the cam ring in an axial direction, one of the side walls including a suction portion and a discharge portion, the suction portion being opened to the hydraulic chambers whose the volumes are increased when the cam ring is moved in a direction to increase the eccentric amount of the cam ring, and the discharge portion being formed by being separated from the suction portion, in a direction of the rotation of the rotor by separation walls each having a circumferential width greater than a circumferential width of the hydraulic chambers, and which is opened to the hydraulic chambers whose the volumes are decreased when the cam ring is moved in the direction to increase the eccentric amount of the cam ring; an urging member arranged to urge the cam ring in the direction to increase the eccentric amount of the cam ring; a control hydraulic chamber arranged to receive a discharge pressure, and thereby to urge the cam ring by the discharge pressure in a direction to decrease the eccentric amount of the cam ring, against the urging force of the urging member; and an introduction passage arranged to introduce the discharge pressure to at least one of the hydraulic chambers which is other than the hydraulic chambers that are opened to the discharge portion when the eccentric amount of the cam ring becomes equal to or greater than a predetermined amount, and arranged not to introduce the discharge pressure to the hydraulic chambers when the eccentric amount of the cam ring is maximized.

According to still another aspect of the invention, a variable displacement pump comprises: a pump constituting section arranged to increase and decrease volumes of a plurality of hydraulic chambers by rotating a rotor, and thereby to discharge an oil introduced from a suction portion, from a discharge portion; a variable mechanism arranged to move a movable member by a discharge pressure of the oil discharged by the pump constituting section, and thereby to vary the volumes of the hydraulic chambers opened to the discharge portion; an urging member arranged to constantly urge the movable member in a direction to increase variations of the volumes of the hydraulic chambers opened to the discharge portion; and an introduction passage arranged so as not to introduce the discharge pressure to one of the hydraulic chambers in a state where the variations of the volumes of the hydraulic chambers are maximized, and arranged to introduce the discharge pressure to the one of the hydraulic chambers in a region from the suction portion to the discharge portion when the variations of the volumes of the hydraulic chambers are decreased from the maximum state by a predetermined amount by the variable mechanism.

BRIEF DESCRIPTION OF THE DRAWINGS

FIGS. 7A-7C show cross sections of the introduction grooves.

FIG. 9A is a sectional view corresponding to FIG. 3. FIG. 9B is a sectional view corresponding to FIG. 6.

FIG. 10A is a sectional view corresponding to FIG. 3. FIG. 10B is a sectional view corresponding to FIG. 6.

FIG. 11A is a sectional view corresponding to FIG. 3. FIG. 11B is a sectional view corresponding to FIG. 6.

FIG. 15A is a view corresponding to FIG. 4. FIG. 15B is a view corresponding to FIG. 6.

FIG. 16A shows the cover member in which the only introduction groove is formed. FIG. 16B shows the cover member in which the only suction and discharge ports are formed. FIG. 16C shows the cover member in which none of the introduction groove, the suction and discharge ports are formed.

DETAILED DESCRIPTION OF THE INVENTION

Hereinafter, variable displacement oil pumps according to embodiments of the present invention will be illustrated in detail with reference to the drawings. In these embodiments, the variable displacement pumps according to the present invention are applied as hydraulic pressure sources arranged to supply a lubricant of an internal combustion engine for a vehicle, to sliding portions of the internal combustion engine, and to a valve timing control apparatus configured to control opening and closing timings of valves of the engine.

Figure 1:
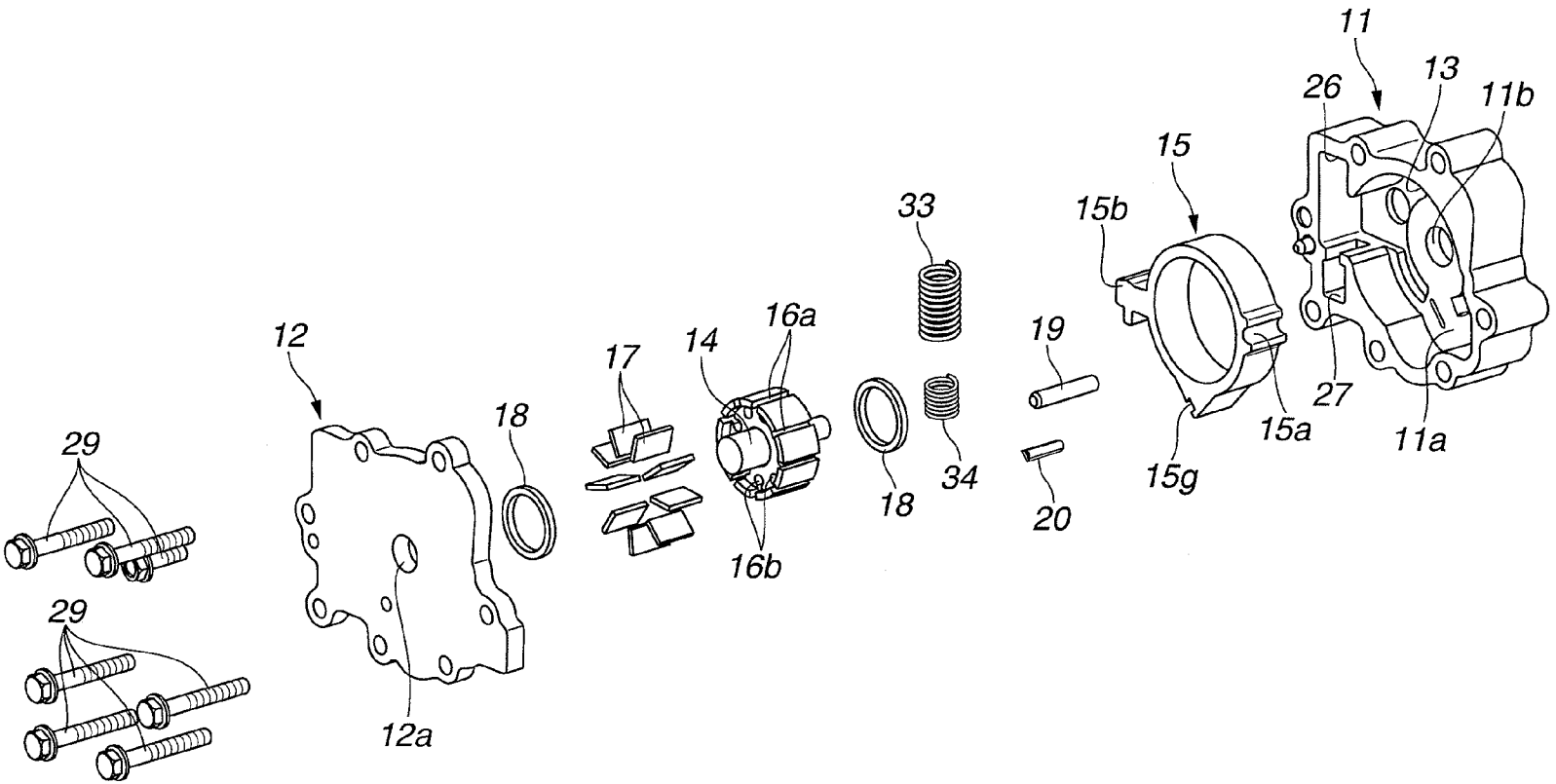
FIG. 1 is an exploded perspective view showing a variable displacement oil pump according to a first embodiment of the present invention.
Figure 2:
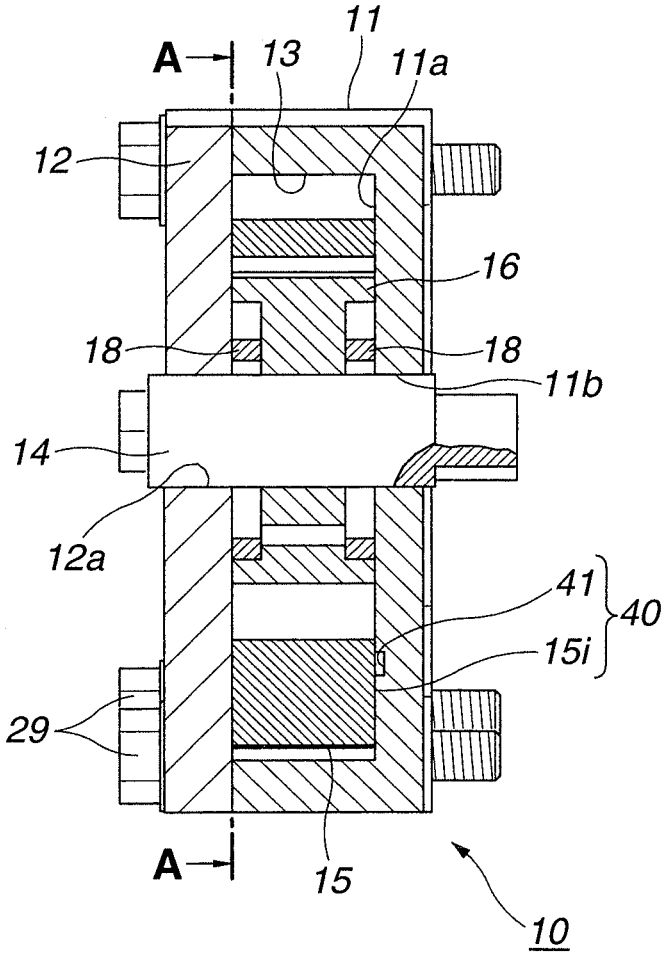
FIG. 2 is a longitudinal sectional view taken along a drive shaft of the variable displacement oil pump of FIG. 1.
Figure 3:
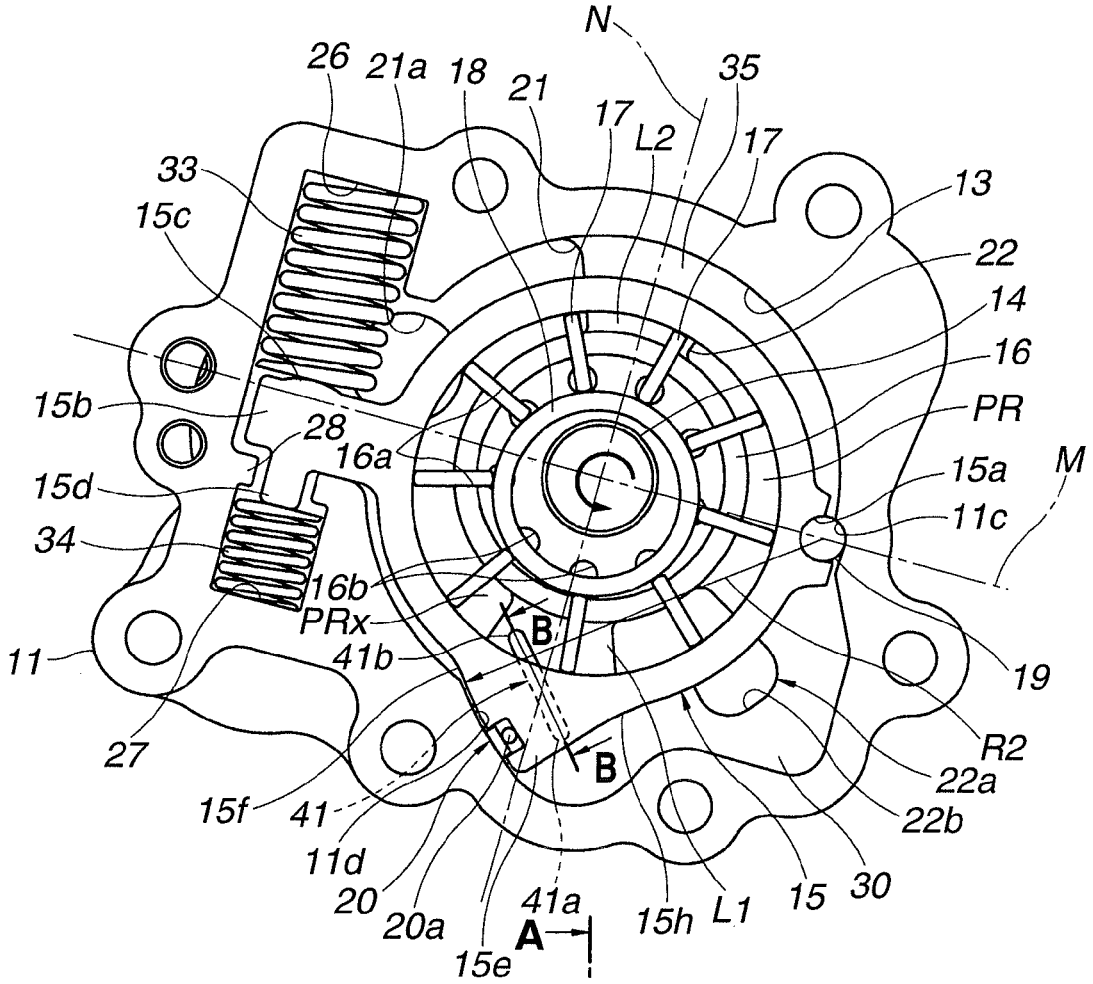
FIG. 3 is a sectional view taken along a section line A-A of FIG. 2.

FIGS. 1-11 show an oil pump according to a first embodiment of the present invention. As shown in FIGS. 1-3, this oil pump 10 includes a pump housing which is provided at a front end portion of a cylinder block of the internal combustion engine (not shown) and a front end portion of a balancer apparatus, and which includes a pump body 11 that has a substantially U-shaped longitudinal section, and that includes a pump receiving chamber 13 that has an opening located on one end side of pump body 11, and a cover member 12 closing the opening of the pump body 11; a driving shaft 14 which penetrates through a substantially center portion of pump receiving chamber 13, and which is rotatably driven by a crank shaft (not shown), a balancer shaft (not shown) and so on; a cam ring 15 which is a movable member movably (swingably) disposed within pump receiving chamber 13; a pump constituting (forming) section which is disposed radially inside cam ring 15, and which is arranged to increase or decrease volumes of pump chambers PR that are a plurality of hydraulic chambers formed between the pump constituting section and cam ring 15, by being driven by driving shaft 14 in a counterclockwise direction of FIG. 3, and thereby to perform a pump operation.

The pump constituting section includes a rotor 16 which is rotatably received radially inside cam ring 15, and which has a central portion connected to an outer circumference surface of driving shaft 14; vanes 17 each of which is received within one of a plurality of slits 16*a* that are formed by cutting out on the outer circumference portion of rotor 16, and that extend in the radial directions; and a pair of ring members 18 and 18 each of which has a diameter smaller than a diameter of rotor 16, and which are disposed on both side surfaces of rotor 16 on the inner circumference side of rotor 16.

Pump body 11 is integrally formed from aluminum alloy. Pump body 11 includes an end wall 11*a* which is a side wall that constitutes one end wall of pump receiving chamber 13; and a bearing hole 11*b* which is formed at a substantially central position of end wall 11*a*, which penetrates through end wall 11*a*, and which rotatably supports one end portion of driving shaft 14. Moreover, pump body 11 includes a support groove 11*c* which is formed by cutting out on the inner circumference wall of pump receiving chamber 13, which has a substantially semi-circular cross section, and which swingably support cam ring 15 through a rod-like pivot pin 19. Furthermore, pump body 11 includes a seal sliding surface 11*d* which is formed on the inner circumference wall of pump receiving chamber 13, which is located on a lower side in FIG. 4 of a line (hereinafter, referred to as a cam ring reference line) M connecting a center of bearing hole 11*b* and a center of support groove 11*c*, and on which a seal member 20 disposed at an outer circumference portion of cam ring 15 is slidably abutted. This seal sliding surface 11*d* is formed into an arc shape having a predetermined radius R1 from the center of support groove 11*c*. This seal sliding surface 11*d* has a circumferential length by which seal member 20 is constantly slidably abutted on seal sliding surface 11*d* in a range in which cam ring 15 is swung to be eccentric. When cam ring 15 is swung to be eccentric, cam ring 15 is guided to be slidably moved along seal sliding surface 11*d*. With this, it is possible to obtain smooth actuation (eccentric swing movement) of cam ring 15.

Figure 4:
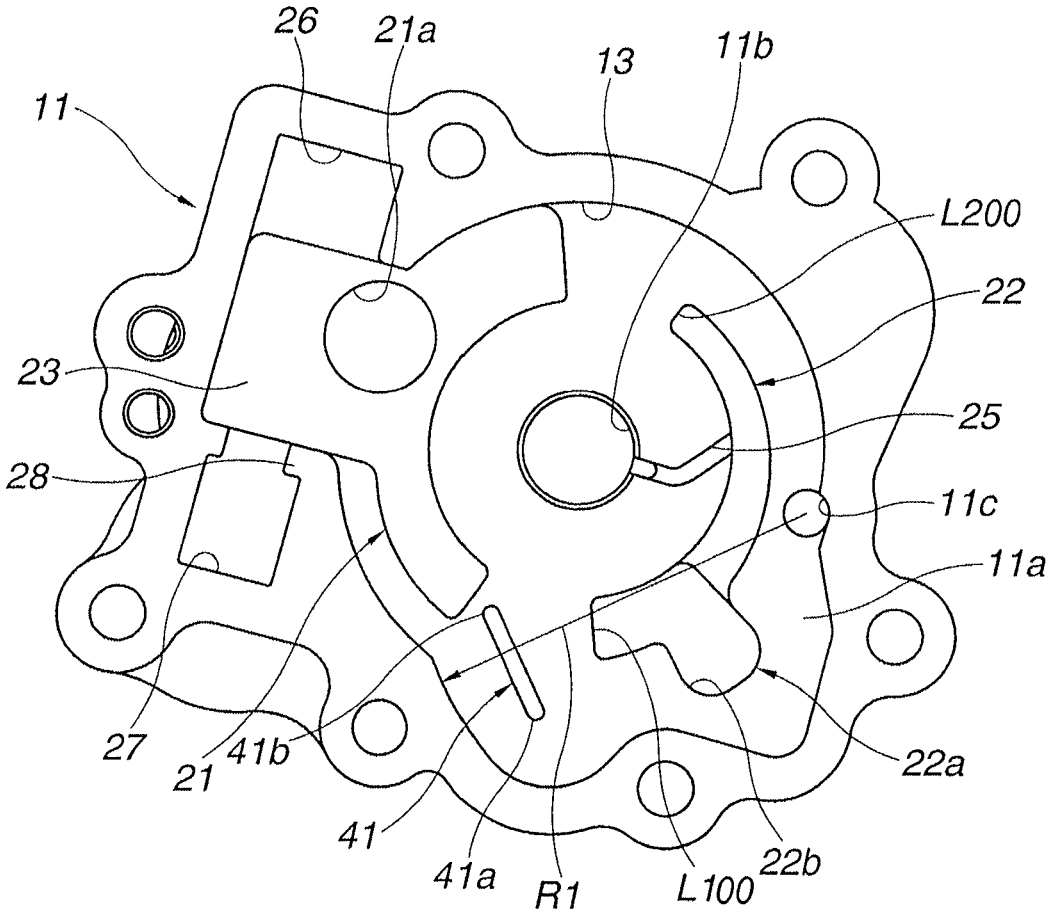
FIG. 4 is a view showing a pump body of the variable displacement oil pump of FIG. 1, as viewed from a side of a mating surface with a cover member.

Moreover, as shown in FIGS. 3 and 4, pump body 11 includes a suction port 21 which is a suction portion, which is formed by cutting out in the inner side surface of end wall 11*a* in the outer circumferential region of bearing hole 11*b*, which has a substantially arc recessed shape, and which is opened to a region (hereinafter, referred to as a suction region) in which volumes of pump chambers PR are increased in accordance with the pump operation of the pump constituting section. Furthermore, as shown in FIGS. 3 and 4, pump body 11 includes a discharge port 22 which is a discharge portion, which is formed by cutting out on the inner side surface of end wall 11*a* in the outer circumferential region of bearing hole 11*b*, which has a substantially arc recessed shape, and which is opened to a region (hereinafter, referred to as a discharge region) in which the volumes of pump chambers PR are decreased in accordance with the pump operation of the pump constituting section. Suction port 21 and discharge port 22 are disposed to substantially confront each other to sandwich bearing hole 11*b*. Suction port 21 and discharge port 22 are separated in the circumferential direction by a first land portion L1 (corresponding to a separation wall) and a second land portion L2 which constitute a pair of confine portions that are located at boundaries between the suction region and the discharge region. Each of first and second land portions L1 and L2 has a circumferential width greater than those of pump chambers PR.

Suction port 21 includes an introduction portion 23 which is located at a substantially central position of suction port 21 in the circumferential direction, and which expands toward a first spring receiving chamber 26 (described later), and which is integrally formed with suction port 21. Moreover, suction port 21 includes a suction opening 21*a* which is located at a position that is near a boundary between introduction portion 23 and suction port 21, and that is on a start end side of suction port 21, which penetrates through end wall 11*a* of pump body 11, and which is connected with the outside. By the thus-constructed structure, the lubricant stored in an oil pan (not shown) of the internal combustion engine is sucked into pump chambers PR in the suction region through suction opening 21*a* and suction port 21, based on the negative pressure generated in accordance with the pump operation of the pump constituting section. Suction opening 21*a* is connected with introduction port 23, and also a low pressure chamber 35 formed in the suction region in the outer circumference region of cam ring 15. Accordingly, the hydraulic fluid with the low pressure which is the suction pressure is also introduced into the low pressure chamber 35.

Discharge port 22 includes a discharge opening 22*a* which is formed by cutting out, which is located at a start end portion of discharge port 22, which penetrates through end wall 11*a* of pump body 11, and which is opened to the outside. By this structure, the hydraulic fluid which is pressurized by the pump operation of the pump constituting section, and which is discharged to discharge port 22 is supplied from discharge opening 22*a* to the sliding portions (not shown) of the internal combustion engine, the valve timing control apparatus (not shown) and so on, through oil main galleries (not shown) that are provided in the cylinder block. Moreover, discharge opening 22*a* includes an enlarged portion 22*b* which is formed at a part of discharge opening 22*a* in the circumferential direction, which expands in the radially outward direction to the outer circumference region of cam ring 15, and which connects discharge opening 22*a* and control hydraulic chamber 30.

At a terminal end portion of discharge port 22, there is formed a connection groove 25 which is formed by cutting out, and which connects discharge port 22 and bearing hole 11*b*. The hydraulic fluid is supplied through this connection groove 25 to bearing hole 11*b*, and also to rotor 16 and side portions of vanes 17. With this, it is possible to ensure the good lubrication of the sliding portions. Connection groove 25 is formed so as not to correspond to the movement directions of vanes 17 in the radially outward direction and in the radially inward direction. With this, it is possible to suppress vanes 17 from dropping into connection groove 25 when vanes 17 are moved in the radially outward direction and in the radially inward direction.

Figure 5:
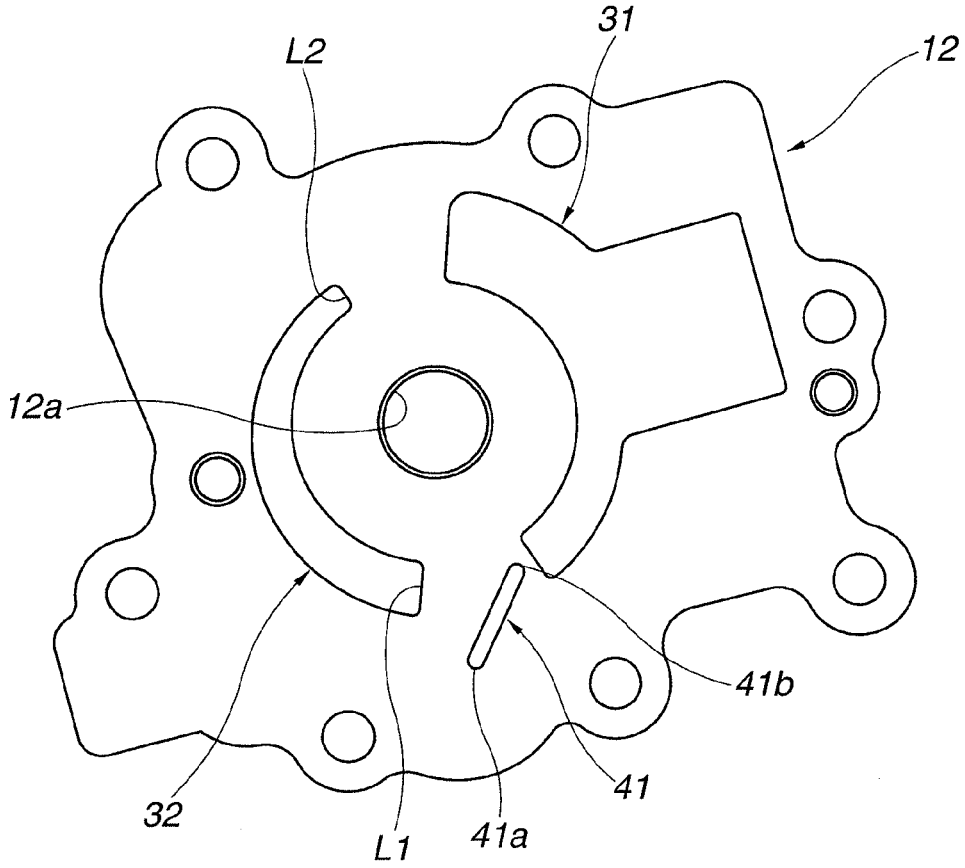
FIG. 5 is a view showing a cover member of the variable displacement oil pump of FIG. 1, as viewed from a side of a mating surface with a pump body.

As shown in FIGS. 2 and 5, cover member 12 has a substantially plate shape. Cover member 12 is mounted to the opening end surface of pump body 11 by a plurality of bolts B1. Cover member 12 constitutes a part of the side wall. Cover member 12 includes a bearing hole 12*a* which is located at a position to confront bearing hole 11*b* of pump body 11, which penetrates through cover member 12, and which rotatably supports the other end portion of driving shaft 14. This cover member 12 includes a suction port 31 which is formed by cutting out, which is located at a position to confront suction port 21 of pump body 11, and which has a shape substantially identical to the shape of suction port 21; and a discharge port 32 which is formed by cutting out, which is located at a position to confront discharge port 22 of pump body 11, and which has a shape substantially identical to the shape of discharge port 22.

As shown in FIG. 2, driving shaft 14 includes an axial end portion (the one end portion) which penetrates through end wall 11*a* of pump body 11 to protrude to the outside, and which is connected to the crank shaft (not shown) and so on. Driving shaft 14 rotates rotor 16 in the counterclockwise direction of FIG. 3 based on a torque (rotational force) transmitted from the crank shaft and so on. In this case, as shown in FIG. 3, a line (hereinafter, referred to as a cam ring eccentric direction line) N perpendicular to cam ring reference line M is a boundary between the suction region and the discharge region.

As shown in FIGS. 1 and 3, rotor 16 includes a plurality of slits 16*a* each formed by cutting out to extend from the center side of rotor 16 in the radially outward direction. Moreover, rotor 16 includes back pressure chambers 16*b* each of which has a substantially circular cross section, each of which is formed at a radially inner end of one of slits 16*a*, and into which the discharge pressure is introduced. Each of vanes 17 is pushed and moved in the radially outward direction by the centrifugal force caused by the rotation of rotor 16 and the pressure within the corresponding back pressure chamber 16*b*.

Each of vanes 17 has a tip end (radially outer end) which is slidably abutted on the inner circumference surface of cam ring 15 at the rotation of rotor 16, and a base end (radially inner end) which is slidably abutted on the outer circumference surfaces of ring members 18 and 18 at the rotation of rotor 16. That is, these vanes 17 are pushed in the radially outward directions by ring members 18 and 18. Accordingly, even when the engine speed is low and the centrifugal force and the pressures of back pressure chambers 16*b* are small, the tip ends of vanes 17 are slidably abutted on the inner circumference surface of cam ring 15 so that pump chambers PR are liquid-tightly separated.

Cam ring 15 is integrally formed from sintered metal into a substantially hollow cylindrical shape. Cam ring 15 includes a pivot portion 15*a* which has a substantially arc recessed shape, which is located at a predetermined position of the outer circumference portion of cam ring 15, which is formed by cutting out to extend in the axial direction, and which serves, by being mounted on pivot pin 19, as an eccentric swing point about which cam ring 15 is swung; and an arm portion 15*b* which is located at a position opposite to pivot portion 15*a* with respect to the center of cam ring 15, which protrudes in the radial direction, and which is linked with a first spring 33 having a predetermined spring constant and a second spring 34 having a spring constant smaller than the spring constant of first spring 33. First spring 33 and second spring 34 are disposed on both sides of arm portion 15*b* of cam ring 15 to confront each other. Arm portion 15*b* includes a pressing protrusion portion 15*c* which is formed on one side portion in the movement direction (pivot direction) of arm portion 15*b*, and which has a substantially arc raised shape to protrude; and a pressing protrusion 15*d* which is formed on the other side portion in the movement direction (pivot direction) of arm portion 15*b* to protrude, and which has a length longer than a thickness of a restriction portion 28 (described later). Arm portion 15*b* and first and second springs 33 and 34 are linked with each other by constantly abutting pressing protrusion portion 15*c* on a tip end portion of first spring 33, and by constantly abutting pressing protrusion 15*d* on a tip end portion of second spring 34.

By the thus-constructed structure, as shown in FIGS. 3 and 4, pump body 11 includes first spring receiving chamber 26 which is located at a position to confront support groove 11*c* (at a position opposite to support groove 11*c* with respect to bearing hole 11*b*), and which receives first spring 26, and a second spring receiving chamber 27 which is located at a position to confront support groove 11*c* (at a position opposite to support groove 11*c* with respect to bearing hole 11*b*), and which receives second spring 27. These first spring receiving chamber 26 and second spring receiving chamber 27 are formed adjacent to pump chambers 13 to extend along cam ring eccentric direction line N of FIG. 4. First spring 33 having the predetermined set load W1 is elastically received within first spring receiving chamber 26 between an end wall of first spring receiving chamber 26 and arm portion 15*b* (pressing protrusion portion 15*c*). Second spring 34 having a predetermined set load W2 is elastically received within second spring receiving chamber 27 between an end wall of second spring receiving chamber 27 and arm portion 15*b* (pressing protrusion 15*d*). Second spring 34 has a wire diameter smaller than that of first spring 33. Pump body 11 includes restriction portion 28 which is located between first and second spring receiving chambers 26 and 27, and which has a stepped shape to decrease its diameter. The other side portion (on a lower side of FIG. 4) of arm portion 15*b* is abutted on one side portion (on an upper side of FIG. 4) of restriction portion 28, so that the pivot region of arm portion 15*b* in the counterclockwise direction is restricted. On the other hand, the tip end of second spring 34 is abutted on the other side portion (on the lower side of FIG. 4) of restriction portion 28, so that the maximum elongation of second spring 34 is restricted.

In this way, cam ring 15 is constantly urged through arm portion 15*b* in a direction (in the counterclockwise direction of FIG. 4) in which the eccentric amount of cam ring 15 is increased, by a resultant force (total force) of set loads W1 and W2 of first and second springs 33 and 34, that is, by the urging force of first spring 33 having the relatively large spring load. Accordingly, in the nonactuation state, pressing protrusion 15*d* of arm portion 15*b* enters second spring receiving chamber 27 so as to compress second spring 34, as shown in FIG. 3. Consequently, the other side portion of arm portion 15*b* is pressed on the one side portion of restriction portion 28, so that cam ring 15 is restricted to a maximum eccentric position.

As shown in FIG. 3, cam ring 15 includes a seal constituting portion 15*e* which is formed at an outer circumference portion of cam ring 15 to protrudes outwards, which has a substantially triangular cross section, and which includes a seal surface 15*f* that has an arc shape having a center identical to the center of seal sliding surface 11*d*, and that is formed to confront seal sliding surface 11*d* of pump body 11. Seal surface 15*f* of this seal constituting portion 15*e* includes a seal holding groove 15*g* which has a substantially rectangular cross section, and which is formed by cutting out to extend in the axial direction. A seal member 20 is received and held within seal holding groove 15*g*. This seal member 20 is slidably abutted on seal sliding surface 11*d* at the eccentric swing movement of cam ring 15.

This seal surface 15*f* has a predetermined radius R2 slightly smaller than radius R1 of seal sliding surface 11*d*. Between seal sliding surface 11*d* and seal surface 15*f*, there is formed a minute clearance. On the other hand, seal member 20 is made from, for example, fluorine resin having low frictional characteristic. Seal member 20 is formed into a linear elongated shape extending in the axial direction of cam ring 15. Seal member 20 is pressed against sliding surface 11*d* by an elastic member 20*a* which is made from rubber, and which is disposed on a bottom portion of seal holding groove 15*g*, so as to liquid-tightly separate between seal sliding surface 11*d* and seal surface 15*f*.

Moreover, in an outer circumference region of cam ring 15, there is formed control hydraulic chamber 30 separated by pivot pin 19, seal member 20, an outer circumference surface of cam ring 15, and an inner side surface of the housing (pump body 11 and cover member 12). The discharge pressure is introduced through enlarged portion 22*b* into this control hydraulic chamber 30. The discharge pressure introduced into this control hydraulic chamber 30 is acted on a pressure receiving surface 15*h* constituted by a side surface of seal constituting portion 15*e* confronting control hydraulic chamber 30, so that cam ring 15 receives the swing force (movement force) in a direction (in the clockwise direction of FIG. 3) to decrease the eccentric amount of cam ring 15. That is, control hydraulic chamber 30 urges cam ring 15 through pressure receiving surface 15*h* by the internal pressure of control hydraulic chamber 30 in a direction (hereinafter, referred to as a concentric direction) in which the center of cam ring 15 approaches the center of the rotation of rotor 16, so that the movement amount of cam ring 15 in the concentric direction is controlled.

In this case, seal sliding surface 11*d* is located on the suction port 21's side of cam ring eccentric direction line N passing through the center of the rotation of rotor 16. Moreover, control hydraulic chamber 30 separated by seal sliding surface 11*d* is located on the discharge port 22's side of cam ring eccentric direction line N. By the above-described disposition of seal sliding surface 11*d* on the suction port 21's side of cam ring eccentric direction line N, the air included in the oil of control hydraulic chamber 30 is discharged by the negative pressure of the suction region to low pressure chamber 35 through the clearances between seal constituting portion 15*e* and the inside surfaces of pump body 11 and cover member 12. By the above-described disposition of control hydraulic chamber 30 on the discharge port 22's side of cam ring eccentric direction line N, the oil leaked from pump chambers PR in the discharge region can enter control hydraulic chamber 30, so that the oil is easy to be stored within control hydraulic chamber 30. Accordingly, the internal pressure of control hydraulic chamber 30 is sufficiently acted on pressure receiving surface 15*h*, so that the swing movement of cam ring 15 is appropriately controlled.

By the thus-constructed structure, in this oil pump 10, the urging force in the eccentric direction based on the spring load of first spring 33, and the urging force in the concentric direction based on the spring load of second spring 34 and the internal pressure of control hydraulic chamber 30 are balanced by a predetermined force relationship. When the urging force based on the internal pressure of control hydraulic chamber 30 is smaller than the resultant force W0 (=W1-W2) of the set loads of first and second springs 33 and 34 which is a difference between set load W1 of first spring 33 and set load W2 of second spring 34, cam ring 15 becomes the maximum eccentric state as shown in FIG. 3. On the other hand, when the urging force based on the internal pressure of control hydraulic chamber 30 becomes greater than resultant force W0 of the set loads of first and second springs 33 and 34 in accordance with the increase of the discharge pressure, cam ring 15 is moved in the concentric direction in accordance with the discharge pressure.

Figure 6:
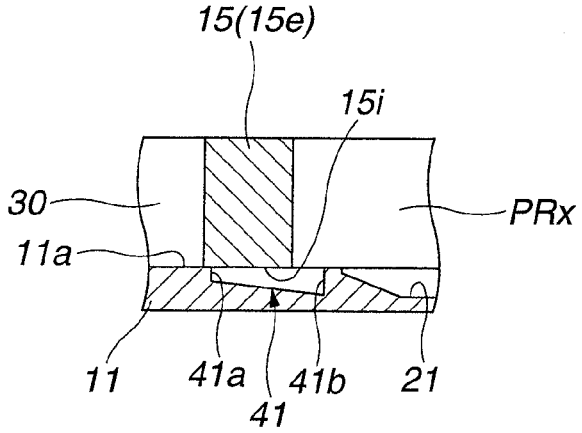
FIG. 6 is a sectional view taken along a section line B-B of FIG. 3.

Moreover, the oil pump 10 includes an introduction passage 40 arranged to connect control hydraulic chamber 30 and pump chambers PR (pump chambers PRx (described later)) superimposed on a first land portion L1 through which pump chambers PR pass when those pump chambers PR are shifted from the suction region (suction port 21) to the discharge region (discharge port 22) in the rotational direction of rotor 16, and arranged to introduce the hydraulic fluid within control hydraulic chamber 30 (the hydraulic pressure corresponding to the discharge pressure) to those pump chambers PR. As shown in FIGS. 3 and 6, this introduction passage 40 is defined by an introduction groove 41 formed by cutting out in an inner side surface of end wall 11*a* of pump body 11 which constitutes first land portion L1, and which is continuous with first land portion L1, and a side surface 15*i* of seal constituting portion 15*e* which is an axial end surface of cam ring 15 that confronts introduction groove 41. This introduction passage 40 is opened and closed (connected and disconnected) by the superimposition state between the cam ring 15 and an end portion (hereinafter, referred to as an outer end portion) 41*a* of introduction groove 41 on the control hydraulic chamber 30's side based on phase of cam ring 15.

Introduction groove 41 is formed in the inner side surface of end wall 11*a* of pump body 11. Introduction groove 41 has a substantially linear (straight) shape extending from control hydraulic chamber 30's side toward first land portion L1 (suction port 21's side) in an oblique direction with respect to the protruding direction of each vane 17, that is, extending along the movement direction of cam ring 15 in substantially parallel with seal sliding surface 11*d* of pump body 11. This introduction groove 41 includes an end portion (hereinafter, referred to as an inner end portion) 41*b* on the pump chamber PR's side. This inner end portion 41*b* is constantly connected with pump chambers PRx (which are confined (closed) by first land portion L1) which are superimposed from the terminal end portion of suction port 21 to first land portion L1. Outer end portion 41*a* is closed by cam ring 15 when cam ring 15 is in the maximum eccentric state, so that the connection between pump chambers PRx and control hydraulic chamber 30 is shut off (cf. FIG. 9). Moreover, when the eccentric amount of cam ring 15 is slightly decreased and the rotational speed of rotor 16 becomes greater than a predetermined rotational speed Rk (described later), an end edge of outer end portion 41*a* of introduction groove 41 is just superimposed on a side end edge of pressure receiving surface 15*h* of cam ring 15, so that a connection between pump chambers PRx and control hydraulic chamber 30 is started (cf. FIG. 10). Moreover, when the eccentric amount of cam ring 15 is further decreased and the rotational speed of rotor 16 becomes a maximum rotational speed Rx (described later), the opening amount of outer end portion 41*a* of introduction groove 41 is increased as shown in FIG. 11, so that pump chambers PRx and control hydraulic chamber 30 are sufficiently connected with each other.

Moreover, as shown in FIG. 6, introduction groove 41 has a downwardly inclined shape (decline shape) to increase its depth in the longitudinal direction (in the rightward direction of FIG. 6) toward pump chamber PRx. Accordingly, a cross-section area of the fluid passage of introduction passage 40 is gradually increased from the control hydraulic chamber 30's side toward the pump chamber PRx's side. Consequently, it is possible to attain a sufficient pressure decreasing function at outer end portion 41*a* of introduction groove 41, and to suppress the unnecessary leakage from control hydraulic chamber 30 through this introduction groove 41 to pump chambers PRx. Moreover, it is possible to ensure a sufficient flow rate in introduction passage 40 for obtaining a cavitation suppression function (described later).

Figure 7A:
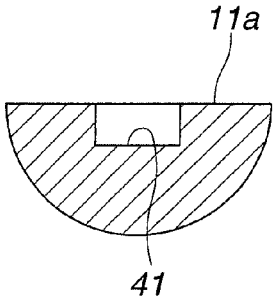
FIGS. 7A-7C are views showing variations of the introduction groove shown in FIG. 6.
Figure 7B:
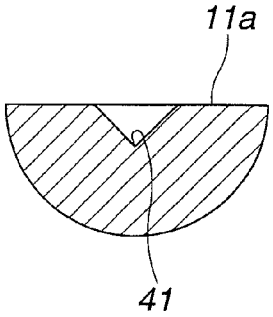
Figure 7C:
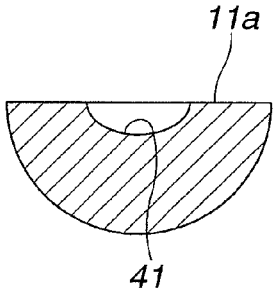

Moreover, as shown in FIG. 7A, introduction groove 41 has a shape having a width greater than a depth. By this structure, it is possible to introduce and act the hydraulic pressure to broader (wider) area of pump chambers PRx. Specifically, introduction groove 41 has a substantially rectangular cross section. Accordingly, it is possible to ensure the broader cross-section area of the fluid passage of introduction passage 40, and thereby to increase the flow rate of introduction passage 40. Furthermore, it is optional to employ, as the cross sectional shape of introduction groove 41, a substantially triangular shape shown in FIG. 7B, and a substantially semicircular shape shown in FIG. 7C, in addition to the rectangular shape shown in FIG. 7A. By employing these shapes, it is possible to readily form (process) introduction groove 41.

Hereinafter, functions (effects) of oil pump 10 according to this embodiment of the present invention are illustrated with reference to FIGS. 8-11.

Figure 8:
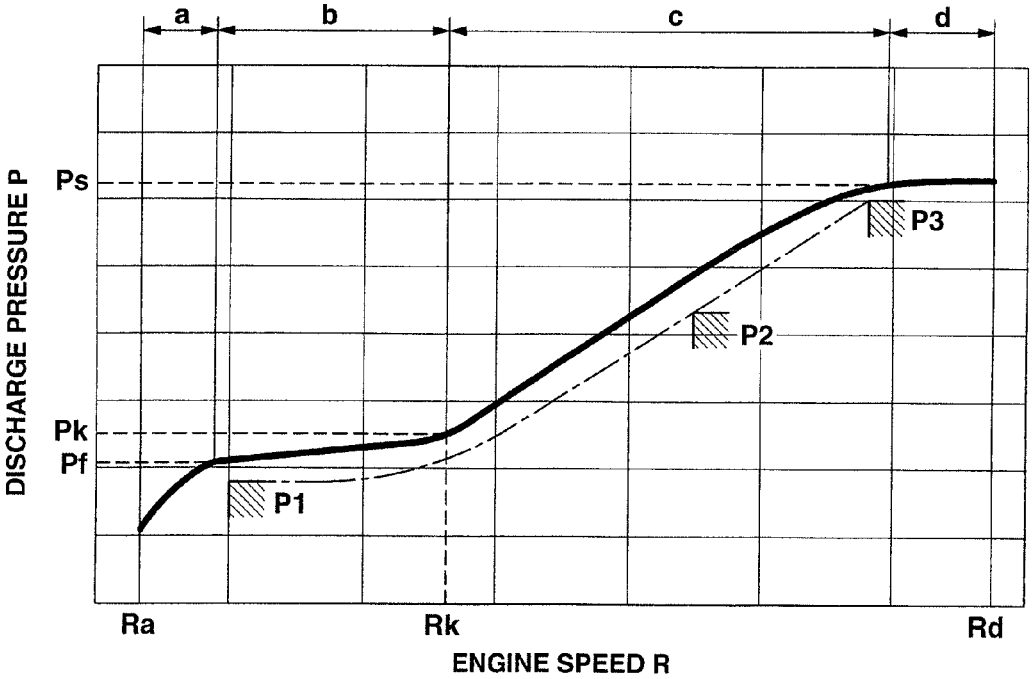
FIG. 8 is a graph showing a hydraulic characteristic of the variable displacement oil pump of FIG. 1.

First, a necessary hydraulic pressure of the internal combustion engine is illustrated as a reference of the discharge pressure control of oil pump 10. For example, in a case where a valve timing control apparatus is employed, a symbol P1 in FIG. 8 is a first engine necessary hydraulic pressure corresponding to a hydraulic pressure necessary for the valve timing control apparatus arranged to improve the fuel consumption, and so on. In a case where an oil jet is employed, a symbol P2 in FIG. 8 is a second engine necessary hydraulic pressure corresponding to a hydraulic pressure necessary for the oil jet arranged to cool the piston. A symbol P3 in FIG. 8 is a third engine necessary pressure necessary for lubricating bearing portions of the crank shaft at the high engine speed. A chain line connecting these symbols P1-P3 is an ideal necessary hydraulic pressure P according to engine speed R of the internal combustion engine. Besides, a solid line in FIG. 8 represents a characteristic line of the oil pump 10 according to the present invention. Moreover, a symbol Pf in FIG. 8 represents a first actuation hydraulic pressure at which cam ring 15 starts to swing by the urging force based on the internal pressure of control hydraulic pressure 30 against the resultant force of springs 33 and 34. A symbol Ps in FIG. 8 represents a second actuation hydraulic pressure at which cam ring 15 starts to further swing by the urging force based on the internal pressure of control hydraulic pressure 30 against spring load W1 of first spring 33.

Figure 9A:
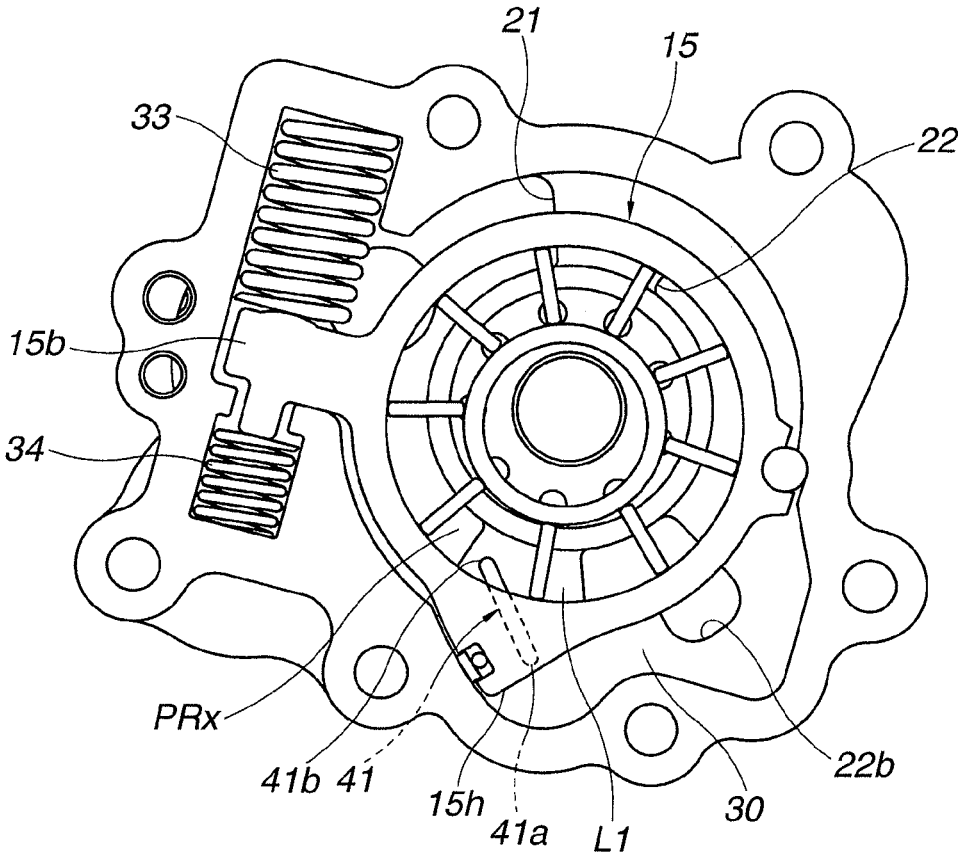
FIGS. 9A and 9B are views showing an actuation state of the pump in a section a of FIG. 8.
Figure 9B:
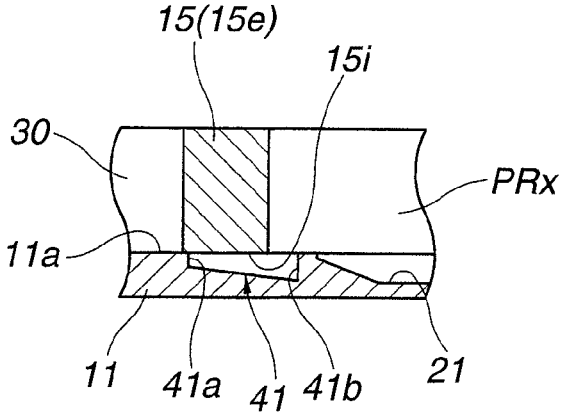
Figure 10A:
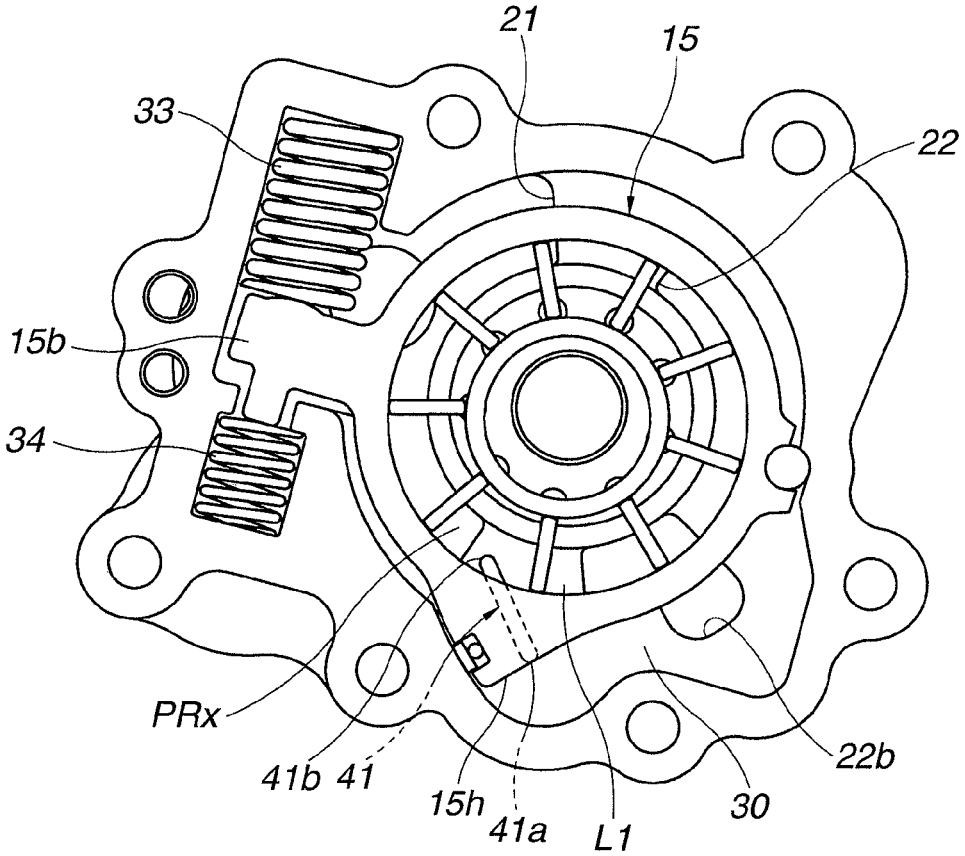
FIGS. 10A and 10B are views showing an actuation state of the pump in a section b of FIG. 8.
Figure 10B:
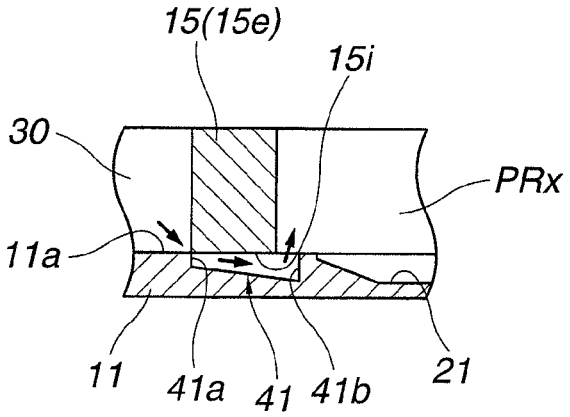

That is, in case of oil pump 10, in a section a of FIG. 8 which corresponds to the engine speed from the start of the engine to the low engine speed, the discharge pressure (the hydraulic pressure within the engine) is smaller than a first actuation hydraulic pressure Pf. Accordingly, as shown in FIG. 9A, cam ring 15 is held to the maximum eccentric state in which arm portion 15*b* is abutted on restriction portion 28, by the urging force based on the resultant (total) force of first and second springs 33 and 34, that is, the urging force based on the spring load of first spring 33 having the relatively large spring load. Consequently, the discharge amount of the pump is maximized, and the discharge pressure P has a characteristic to increase in accordance with the increase of engine speed R to be substantially proportional to engine speed R.

Then, when discharge pressure P reaches a predetermined hydraulic pressure Pk slightly greater than first actuation hydraulic pressure Pf by the increase of engine speed R, cam ring 15 starts to be moved in the concentric direction against the urging force of first spring 33, by the discharge pressure P corresponding to predetermined hydraulic pressure Pk introduced into control hydraulic chamber 30 through enlarged portion 22*b*. Accordingly, the eccentric amount of cam ring 15 is gradually decreased, so that the discharge amount is restricted. Consequently, the increase of discharge pressure P based on the increase of engine speed R is suppressed (cf. a section b in FIG. 8).

Then, when second spring 34 expands in accordance with the movement of cam ring 15 in the concentric direction and the tip end of second spring 34 is abutted on restriction portion 28 (cf. FIG. 10A), the urging force of second spring 25 does not exist, so that the movement of cam ring 15 in the concentric direction is stopped. Consequently, discharge pressure P of oil pump 10 is again increased in accordance with the increase of engine speed R to be substantially proportional to engine speed R (a section c in FIG. 8).

Figure 11A:
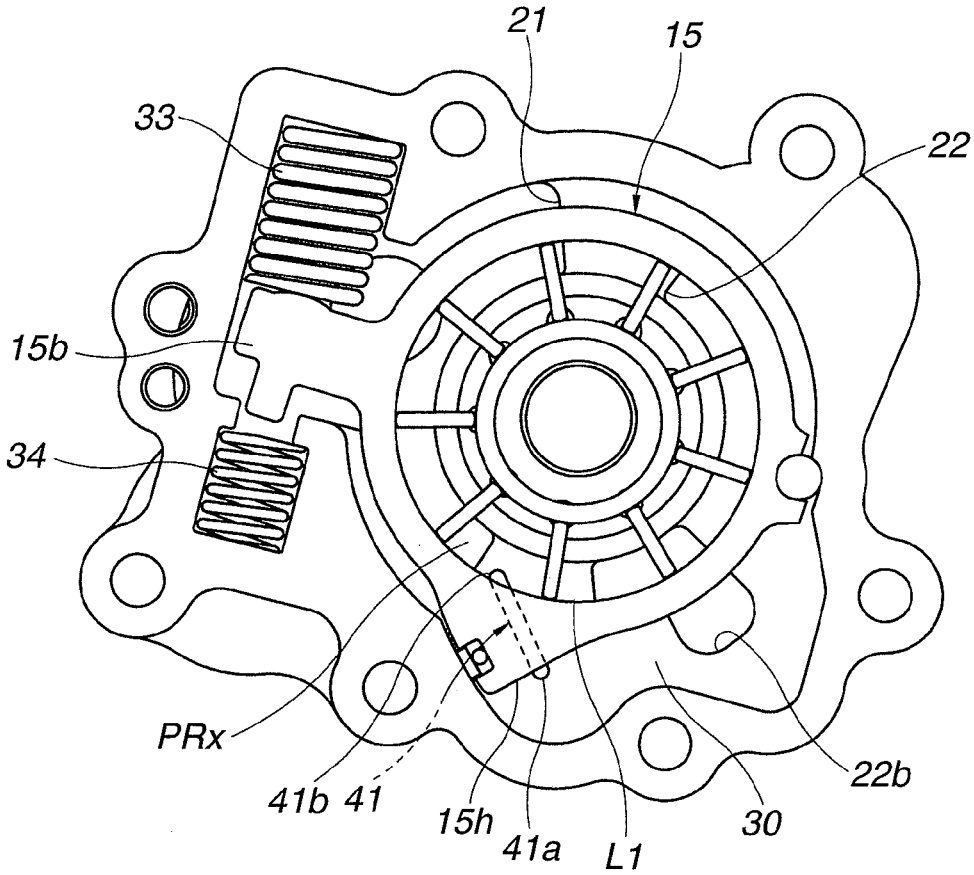
FIGS. 11A and 11B are views showing an actuation state of the pump in a section d of FIG. 8.
Figure 11B:
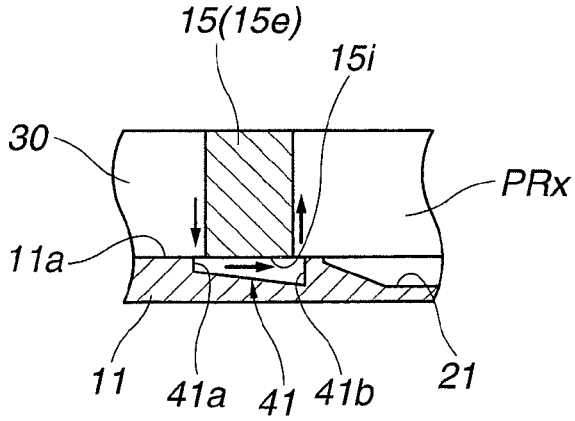

Then, when discharge pressure P reaches second actuation hydraulic pressure Ps set greater than third engine necessary hydraulic pressure P3 in accordance with the above-described characteristic by the further increase of engine speed R, the urging force based on the internal pressure of control hydraulic chamber 30 becomes greater than the urging force of first spring 33, so that cam ring 15 is further moved in the concentric direction, as shown in FIG. 11A. Consequently, the eccentric amount of cam ring 15 is gradually decreased, so that the increase of the discharge amount is restricted. Therefore, the increase of discharge pressure P based on the increase of engine speed R is restricted (a section d in FIG. 8).

In this way, in the oil pump 10 according to this embodiment of the present invention, the swing movement of cam ring 15 is controlled so as to increase discharge pressure P in the multi-step (multi-stage) manner by first and second springs 33 and 34. Accordingly, discharge pressure P is not uselessly increased. Consequently, it is possible to obtain a characteristic corresponding to the ideal necessary hydraulic pressure (the chain line) as much as possible (cf. FIG. 8), relative to the conventional oil pump.

In this case, in a case where the oil pump 10 is driven by a rotational speed higher than the rotational speed of the internal combustion engine in the conventional oil pump, that is, for example, the rotational speed of a balancer apparatus (a balancer shaft) having twice the rotational speed of the crank shaft, the rotational speed of rotor 16 driven by twice the rotational speed is excessively high in a region in which engine speed R is greater than predetermined engine speed Rk at which predetermined hydraulic pressure Pk in FIG. 8 is generated. Consequently, the internal pressure of pump chambers PRx confined by first land portion L1 is decreased. Air bubbles are generated by the cavitation mainly at an upstream portion within pump chamber PRx on the outer circumference side (a radially outward portion of pump chamber PRx which is opposite to the rotational direction of rotor 16).

However, in the oil pump 10 according to this embodiment, when engine speed R reaches predetermined engine speed Rk at which the cavitation may generated, the side end edge of pressure receiving surface 15*h* of cam ring 15 and the end edge of outer end portion 41*a* of introduction groove 41 are just superimposed on each other. With this, the connection between pump chambers PRx and control hydraulic chamber 30 through introduction passage 40 is started. Accordingly, the hydraulic pressure (the positive pressure) within control hydraulic chamber 30 is introduced to pump chambers PRx, so that the negative pressure within pump chambers PRx are tempered (eased up). Consequently, the air bubbles generated in pump chambers PRx are squashed (crushed) by that hydraulic pressure, so that the cavitation is resolved. Therefore, then, when pump chambers PRx are moved to the discharge region and opened to discharge ports 22 and 32, it is possible to suppress adverse effects such as the noise and the erosion by suddenly squashing the air bubbles by the discharge pressure in discharge ports 22 and 32.

In this case, introduction passage 40 has the cross-section area of the flow passage which is set to sufficiently decrease the hydraulic pressure introduced into pump chambers PRx. Accordingly, the hydraulic pressure corresponding to the discharge pressure within control hydraulic chamber 30 is not directly introduced into pump chambers PRx. The hydraulic pressure corresponding to the discharge pressure within control hydraulic chamber 30 is sufficiently decreased, and then introduced into pump chambers PRx. Consequently, this introduction pressure from control hydraulic chamber 30 does not suddenly squash the air bubbles within pump chambers PRx. Therefore, the noise and the erosion are not caused due to the sudden squash of the air bubbles within pump chambers PRx.

Introduction passage 40 is arranged to be opened and closed in accordance with the movement of cam ring 15. Introduction passage 40 is set to be closed to shut off the connection between pump chambers PRx and control hydraulic chamber 30 when engine speed R is in an engine speed region in which the cavitation is not generated, that is, in a low to middle engine speed region from an idling speed Ra to the predetermined engine speed Rk at which the cavitation may be generated. Accordingly, it is possible to suppress the unnecessary leakage of the hydraulic fluid from control hydraulic chamber 30 to pump chambers PRx, and to suppress the decrease of the discharge amount due to the above-described leakage.

On the other hand, the opening area of outer end portion 41*a* of introduction passage 40 is set to be gradually increased in accordance with the movement of cam ring 15. Accordingly, even when engine speed R becomes equal to or greater than the predetermined engine speed Rk, it is possible to introduce the necessary and sufficient hydraulic pressure which is for disappearing the air bubbles, into pump chambers PRx (cf. FIG. 11). Consequently, it is possible to appropriately disappear the air bubbles without causing the noise and so on, and to suppress the unnecessary leakage of the hydraulic pressure.

When discharge pressure P is greater than second actuation hydraulic pressure Ps, that is, when engine speed R is in a very high speed region corresponding to a section d in FIG. 8, the eccentric amount of cam ring 15 is sufficiently decreased, so that the discharge amount is suppressed. Accordingly, the cavitation is improved (resolved). Therefore, in this very high engine speed region, introduction passage 40 may be closed as necessary. By this structure, it is possible to suppress the unnecessary leakage of the hydraulic fluid from control hydraulic chamber 30 to pump chambers PRx, and to suppress the decrease of the discharge pressure based on this leakage, like the low engine speed.

In this way, the oil pump according to this embodiment includes introduction passage 40 which is arranged to connect control hydraulic chamber 30 and pump chambers PRx when engine speed R becomes equal to or greater than the predetermined engine speed Rk at which the cavitation may be generated, and thereby to introduce the hydraulic pressure within control hydraulic chamber 30 to pump chambers PRx. Accordingly, it is possible to resolve the cavitation generated due to the high rotational speed, by the hydraulic pressure within control hydraulic chamber 30 that is introduced through introduction passage 40. With this, even when the oil pump is driven at the high rotational speed by the balancer apparatus and so on, it is possible to suppress the adverse effects such as the noise and the erosion which are caused by the cavitation as much as possible.

Moreover, introduction passage 40 is constituted by introduction groove 41 formed only by cutting out the inner side surfaces of pump body 11 and cover member 12. Accordingly, the structure of pump 10 is not complicated. Moreover, it is possible to minimize the manufacturing (processing) by the addition of introduction passage 40. Therefore, it is possible to suppress the decrease of the productivity of pump 10, and the increase of the manufacturing cost.

Furthermore, introduction passage 40 (introduction groove 41) is formed to extend toward suction port 21's side in the oblique direction with respect to the protruding directions of vanes 17. With this, it is possible to ensure the longer length of introduction passage 40. Accordingly, it is possible to improve the pressure decreasing effect by introduction passage 40. With this, it is possible to more slowly squash the air bubbles generated within pump chambers PRx, and thereby to suppress the adverse effects such as the noise which is caused due to the squash of the air bubbles.

In addition, inner end portion 41*b* of introduction groove 41 is located nearer to suction ports 21 and 31 than to discharge ports 22 and 32. With this, it is possible to introduce the hydraulic pressure within control hydraulic chamber 30 to pump chambers PRx in which the cavitation is prone to be generated. Therefore, it is possible to effectively resolve the cavitation.

Moreover, inner end portion 41*b* of introduction groove 41 is formed on the outer circumference side of first land portion L1 adjacent to suction ports 21 and 31. Accordingly, it is possible to directly introduce the hydraulic pressure within control hydraulic chamber 30 to a portion of pump chambers PRx at which the air bubbles are accumulated. Therefore, it is possible to more effectively disappear the air bubbles.

Moreover, introduction groove 41 has the width greater than the depth of introduction groove 41. Accordingly, it is possible to act the hydraulic pressure within control hydraulic chamber 30 to the wider region of pump chambers PRx in which the air bubbles are generated, and thereby to effectively disappear the air bubbles within pump chambers PRx.

Figure 12:
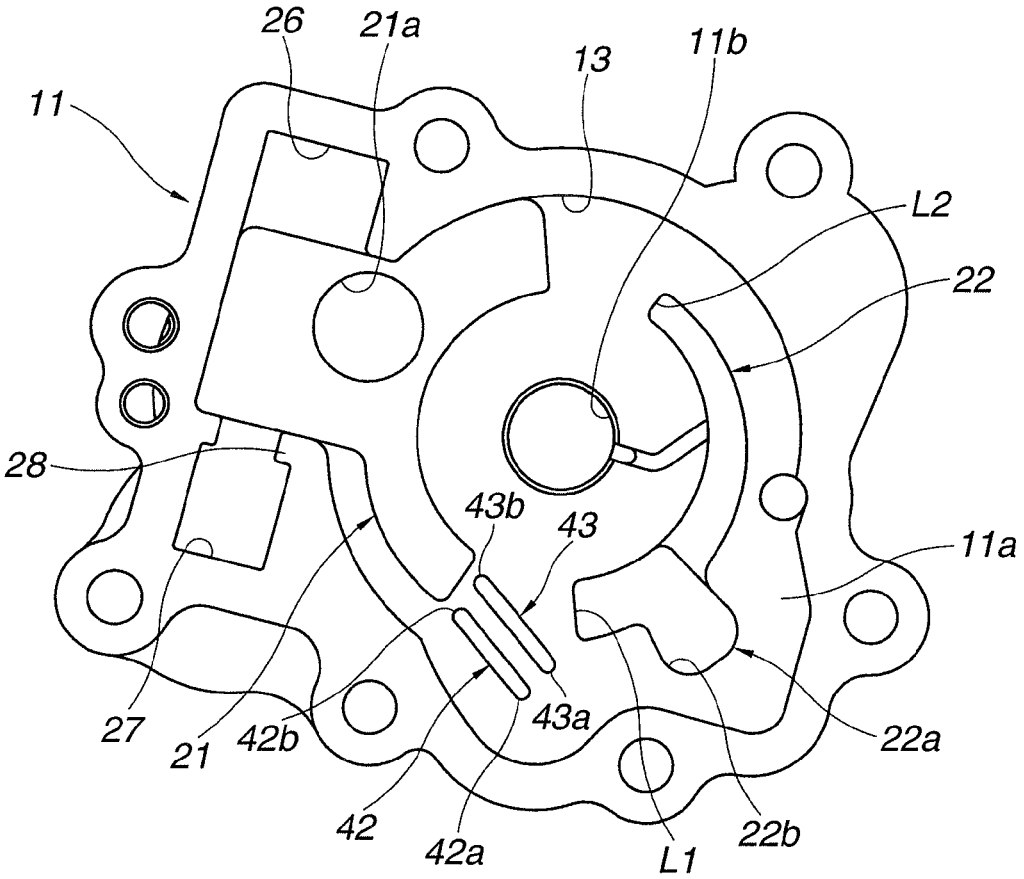
FIG. 12 is a view showing a variable displacement oil pump according to a second embodiment of the present invention, and corresponding to FIG. 4.

FIG. 12 shows a variable displacement oil pump according to a second embodiment of the present invention. In this oil pump according to the second embodiment, the number of introduction groove 41 is increased, relative to the oil pump according to the first embodiment. The oil pump according to the second embodiment is substantially identical to the oil pump according to the first embodiment in most aspects as shown by the use of the same reference numerals. The repetitive illustrations are omitted.

That is, the oil pump according to this embodiment includes a pair of a first introduction groove 42 and a second introduction groove 43 which correspond to introduction groove 41, and which are arranged in the radial direction in first land portion L1 parallel to each other. Both of introduction grooves 42 and 43 constitute two introduction passages 40 between cam ring 15 and each of introduction grooves 42 and 43.

That is, outer end portions 42*a* and 43*a* of introduction grooves 42 and 43 are positioned so as to be opened and closed at the same timing as the first embodiment. That is, the connection of introduction passage 40 is shut off in the low to middle engine speed region. When engine speed R reaches the middle engine speed region, that is, engine speed Rk), introduction passage 40 is connected.

On the other hand, inner end portion 42*b* of first introduction groove 42 disposed on the outer circumference side (on the radially outer side) is formed to be opened to an upstream portion of pump chambers PRx which is on the outer circumference side, and at which the air bubbles are prone to be accumulated. On the other hand, inner end portion 43*b* of second introduction groove 43 disposed on the inner circumference side is formed to be opened to an upstream portion of pump chambers PRx which is on the inner circumference side. That is, these introduction grooves 42 and 43 are formed so that inner end portions 42*b* and 43*b* of introduction grooves 42 and 43 are opened to different radial positions within pump chambers PRx. With this, it is possible to act the hydraulic pressure within control hydraulic chamber 30 to the wider region within pump chambers PRx, at the connection of introduction passage 40.

By this structure, in the oil pump according to the first embodiment, the hydraulic pressure within control hydraulic chamber 30 is acted to the wider region within pump chambers PRx at the connection of introduction passage 40, by first and second introduction grooves 42 and 43. Accordingly, it is possible to effectively squash and disappear the air bubbles generated within pump chambers PRx at the generation of the cavitation. With this, it is possible to rapidly resolve the cavitation, and to effectively suppress the adverse effects such as the noise which are caused by the cavitation.

Figure 13:
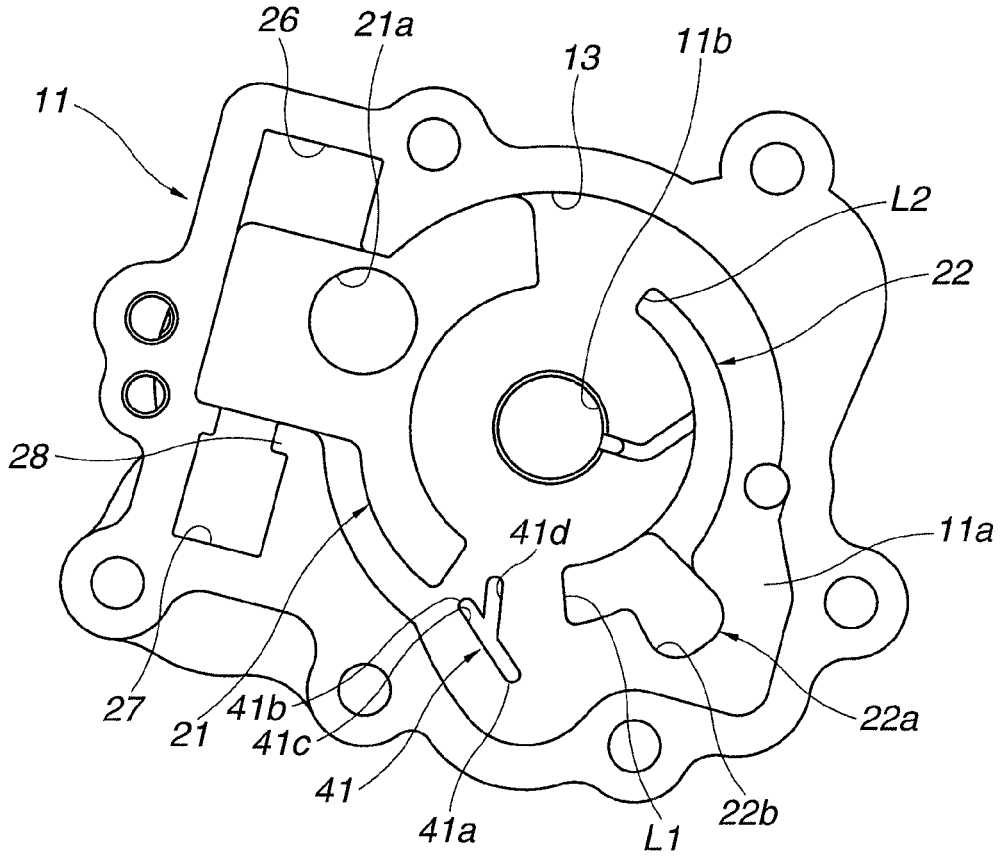
FIG. 13 is a view showing a variable displacement oil pump according to a third embodiment of the present invention, and corresponding to FIG. 4.

FIG. 13 shows a variable displacement oil pump according to a third embodiment of the present invention. In this oil pump according to the third embodiment, the structure on the inner end side of introduction groove 41 in the oil pump according to the first embodiment is varied. The oil pump according to the third embodiment is substantially identical to the oil pump according to the first embodiment in most aspects as shown by the use of the same reference numerals. The repetitive illustrations are omitted.

That is, the inner end side of introduction groove 41 is bifurcated into two portions. That is, the inner end side of introduction groove 41 includes a main portion 41*c* which constitutes a body of introduction groove 41, and which is formed to be opened to an upstream portion of pump chambers PRx which is on the outer circumference side, and at which the air bubbles are prone to be accumulated due to the cavitation; and a branch portion 41*d* which is branched from the body of introduction groove 41, and which is formed to be opened to a downstream portion within pump chambers PRx which is on the inner circumference side. That is, the inner end side of introduction groove 41 is formed to be bifurcated. In particular, main portion 41*c* and branch portion 41*d* which correspond to the end portions of the bifurcated portions are formed to be opened to different radial positions within pump chambers PRx. With this, it is possible to act the hydraulic pressure within control hydraulic chamber 30 to the wider region of pump chambers PRx at the connection of introduction passage 40.

By this structure, the hydraulic pressure within control hydraulic chamber 30 is acted to the wider region within pump chambers PRx by the both end portions 41*c* and 41*d* at the connection of introduction passage 40, like the second embodiment. Accordingly, it is possible to effectively disappear the air bubbles generated within pump chambers PRx at the generation of the cavitation, and to effectively suppress the adverse effects such as the noise which are caused due to the cavitation.

Figure 14:
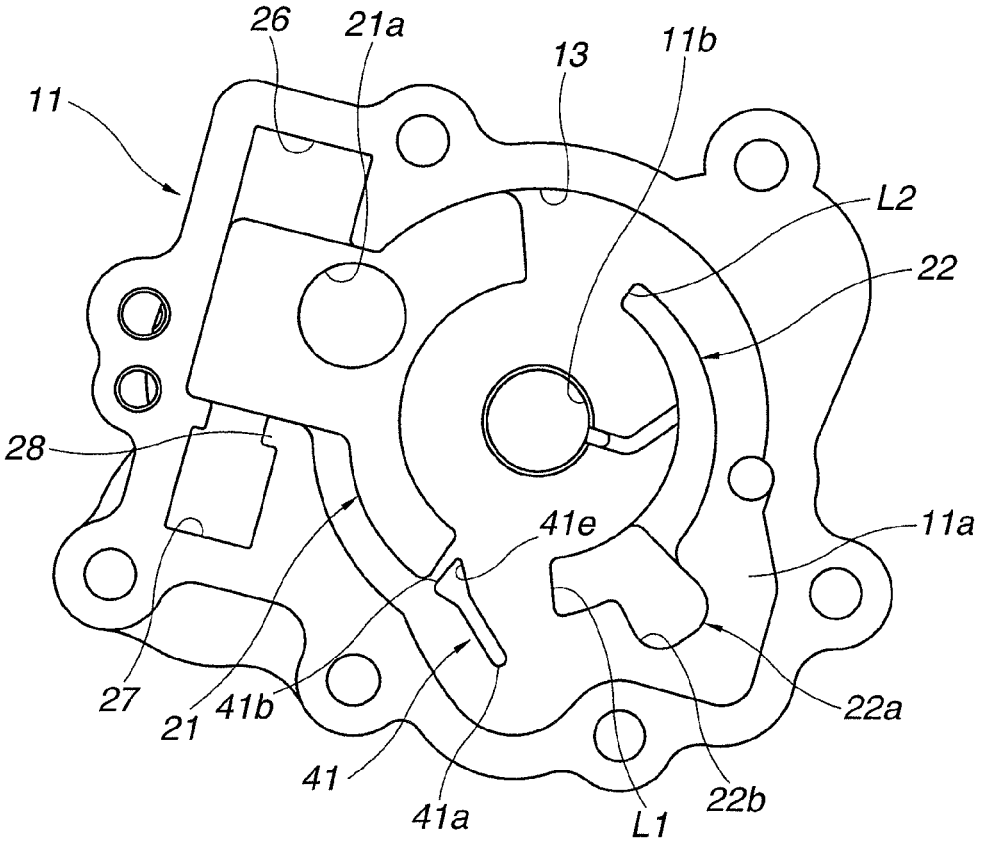
FIG. 14 is a view showing a variable displacement oil pump according to a fourth embodiment of the present invention, and corresponding to FIG. 4.

FIG. 14 shows a variable displacement oil pump according to a fourth embodiment of the present invention. In this oil pump according to the fourth embodiment, the structure on the inner end side of introduction groove 41 of the oil pump according to the first embodiment is varied. The oil pump according to the fourth embodiment is substantially identical to the oil pump according to the first embodiment in most aspects as shown by the use of the same reference numerals. The repetitive illustrations are omitted.

That is, in the oil pump according to the fourth embodiment, introduction groove 41 includes a width-increasing portion (flared portion) 41*e* which is formed at the inner end portion of introduction groove 41, and whose a groove width is increased toward inner end portion 41*b*. This width-increasing portion 41*e* has a tip end portion (inner end portion 41*b*) having a groove width substantially identical to that of terminal end portions of suction ports 21 and 31. That is, by this structure, an opening area of inner end portion 41*b* confronting pump chambers PRx is set greater than an opening area of outer end portion 41*a* confronting control hydraulic chamber 30. With this, it is possible to act the hydraulic pressure within control hydraulic chamber 30 to the wider region within pump chambers PRx at the connection of introduction passage 40.

By this structure, in the oil pump according to the fourth embodiment, the hydraulic pressure within control hydraulic chamber 30 is acted by width-increasing portion 41*e* to the wider region within pump chambers PRx at the connection of introduction passage 40. Accordingly, it is possible to effectively squash and disappear the air bubbles generated within pump chambers PRx. Therefore, it is possible to rapidly resolve the cavitation, and to effectively suppress the adverse effects such as the noise which are caused due to the cavitation.

Figure 15A:
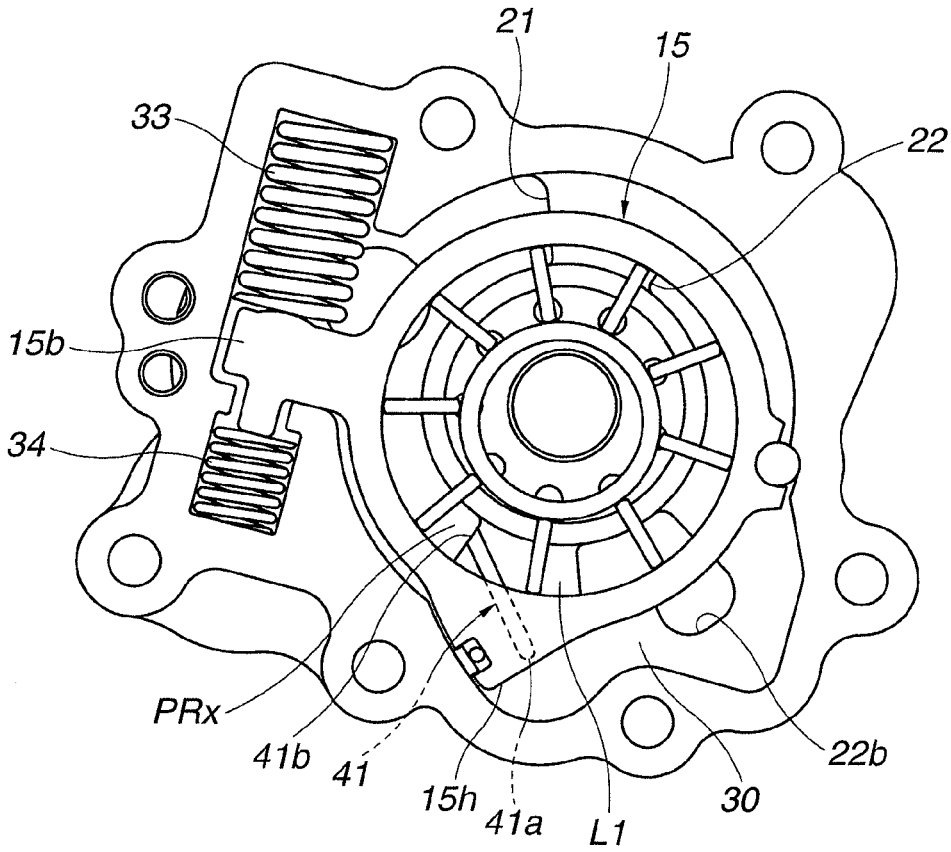
FIGS. 15A and 15B are views showing a variable displacement oil pump according to a fifth embodiment of the present invention.
Figure 15B:
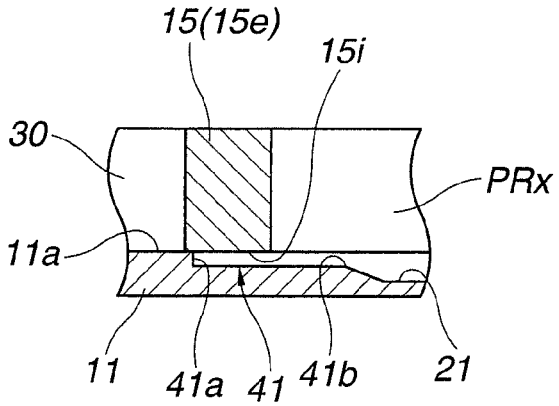

FIG. 15 shows a variable displacement oil pump according to a fifth embodiment of the present invention. In this oil pump according to the fifth embodiment, the structure of inner end portion 41*b* of introduction groove 41 of the oil pump according to the first embodiment is varied. The oil pump according to the fifth embodiment is substantially identical to the oil pump according to the first embodiment in most aspects as shown by the use of the same reference numerals. The repetitive illustrations are omitted.

That is, in the oil pump according to this embodiment, inner end portion 41*b* of introduction groove 41 is elongated so that inner end portion 41*b* is directly connected with the terminal end portions (the end portions on the downstream side in the rotation direction of rotor 16) of suction ports 21 and 31.

By this structure, it is possible to ensure longer section in which the hydraulic pressure within control hydraulic chamber 30 is acted to pump chambers PRx, at the generation of the cavitation, and thereby to effectively disappear the air bubbles generated within pump chambers PRx. Accordingly, by this structure, it is also possible to rapidly resolve the cavitation, and to effectively suppress the adverse effects such as the noise which are caused due to the cavitation.

Moreover, the inner end portion 41*b* of introduction groove 41 is connected with the terminal end portions of suction ports 21 and 31. With this, it is possible to effectively act the hydraulic pressure within control hydraulic chamber 30 to a region of pump chambers PRx in which the air bubbles is prone to be generated at the generation of the cavitation. Therefore, it is possible to more effectively resolve the cavitation.

The present invention is not limited to the structures of the embodiments. For example, engine necessary hydraulic pressures P1-P3, first and second actuation hydraulic pressures Pf and Ps, and predetermined hydraulic pressure Pk may be freely varied in accordance with specifications of the internal combustion engine, the valve timing control apparatus and so on of the vehicle to which oil pump 10 is mounted.

Moreover, introduction groove 41 is not limited to the structures of the embodiments. Number, shape, size, and so on of introduction groove 41 may be arbitrarily varied in accordance with specifications and so on of pump 10 as long as introduction groove 41 is formed in first land portion L1 from the control hydraulic chamber 30's side to extend toward suction ports 21 and 31, and introduction groove 41 can introduce the hydraulic pressure within control hydraulic chamber 30 to at least one of pump chambers PR in the suction region.

Figure 16A:
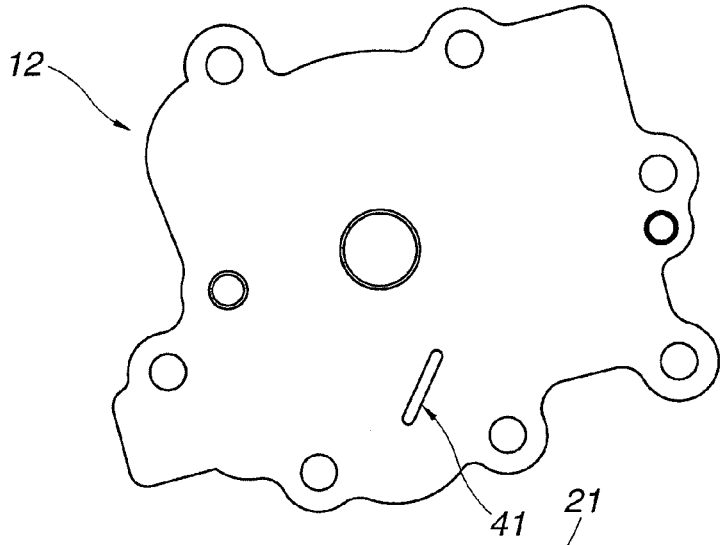
FIGS. 16A-16C are views showing other variations of the cover member of the variable displacement oil pump according to the present invention, and corresponding to FIG. 5.
Figure 16B:
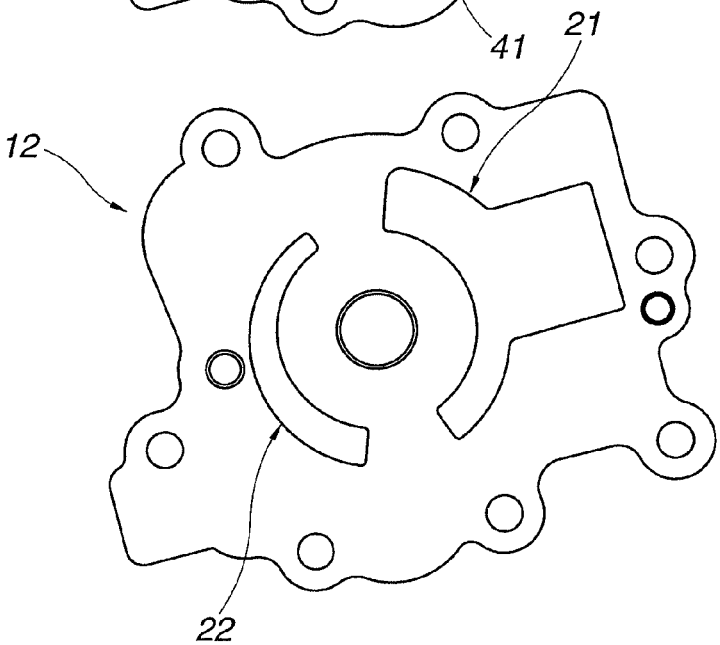
Figure 16C:
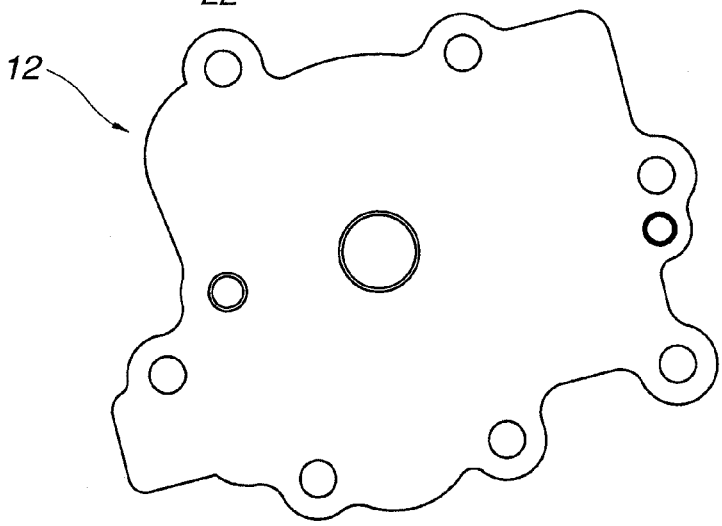

Moreover, in the above-described embodiments, ports 31 and 32 and introduction groove 41 are formed in the inner side surfaces of cover member 12. However, it is not essential that ports 31 and 32 and introduction groove 41 are formed in the cover member 12. Accordingly, the only introduction groove 41 may be formed in cover member 12, as shown in FIG. 16A. Moreover, the only ports 31 and 32 may be formed in cover member 12, as shown in FIG. 16B. Furthermore, none of ports 31 and 32, and introduction groove 41 are formed in cover member 12, as shown in FIG. 16C. Accordingly, it is possible to employ these structures in accordance with the specifications and so on of pump 10.

Moreover, in the above-described embodiments, cam ring 15 is swung (pivoted) as an eccentric amount varying means (section) of cam ring 15 with respect to rotor 16. However, the oil pump according to the present invention can employ any eccentric amount varying means. That is, it is possible to employ any means such as means arranged to vary the eccentric amount of cam ring 15 with respect to rotor 16 by moving cam ring 15 parallel to rotor 16, in addition to the above-described eccentric amount varying means by the swing movement.

A variable displacement pump according to the embodiments of the present invention includes: a rotor driven to rotate; a plurality of vanes which are disposed at an outer circumference portion of the rotor, and each of which is arranged to be moved in a radially inward direction and in a radially outward direction of the rotor; a cam ring which receives the rotor and the vanes therein, which separates a plurality of hydraulic chambers with the rotor and the vanes, and which is arranged to be moved to vary an eccentric amount of a center of an inner circumference surface of the cam ring with respect to a center of a rotation of the rotor, and thereby to increase or decrease volumes of the hydraulic chambers at the rotation of the rotor; side walls provided on both sides of the cam ring in an axial direction, one of the side walls including a suction portion and a discharge portion, the suction portion being opened to the hydraulic chambers whose the volumes are increased when the cam ring is moved in a direction to increase the eccentric amount of the cam ring, and the discharge portion being formed by being separated from the suction portion, in a direction of the rotation of the rotor by separation walls each having a circumferential width greater than a circumferential width of the hydraulic chambers, and which is opened to the hydraulic chambers whose the volumes are decreased when the cam ring is moved in the direction to increase the eccentric amount of the cam ring; an urging member arranged to urge the cam ring in the direction to increase the eccentric amount of the cam ring; a control hydraulic chamber arranged to receive a discharge pressure, and thereby to urge the cam ring by the discharge pressure in a direction to decrease the eccentric amount of the cam ring, against the urging force of the urging member; and an introduction passage which is formed on one of the separation walls across which the hydraulic chambers pass when the hydraulic chambers are moved from the suction portion to the discharge portion, which is arranged to shut off a connection between one of the hydraulic chambers and the control hydraulic chamber by an axial end surface of the cam ring when the cam ring is in a maximum eccentric state, and which is arranged to connect the one of the hydraulic chambers and the control hydraulic chamber by a movement of the cam ring in the direction to decrease the eccentric amount of the cam ring, and thereby to introduce the discharge pressure within the control hydraulic chamber to the one of the hydraulic chambers.

Accordingly, in a region in which the engine speed is equal to or greater than the predetermined engine speed at which the eccentric amount of the cam ring is smaller than the maximum eccentric amount, that is, in a region in which the cavitation is generated, it is possible to introduce the discharge pressure within the control hydraulic chamber by the introduction passage, to the hydraulic chambers in which the air bubbles are generated due to the cavitation by the negative pressure within the hydraulic chambers. Accordingly, it is possible to temper the negative pressure within the hydraulic chambers by this discharge pressure (positive pressure), to disappear the air bubbles generated within the hydraulic chambers, and to resolve the cavitation. With this, it is possible to suppress the adverse effects such as the noise and the erosion as much as possible even when the pump is driven at the high rotational speed.

(a) In the variable displacement pump according to the embodiments of the present invention, the cam ring is received within a housing constituting the side walls; and the control hydraulic chamber includes an outer circumference surface of the cam ring on the introduction passage side of the movement direction of the cam ring, and an inner side surface of the housing.

(b) In the variable displacement pump according to the embodiments of the present invention, the introduction passage is a groove formed in the one of the side walls.

Accordingly, it is possible to readily form the introduction passage.

(c) In the variable displacement pump according to the embodiments of the present invention, the introduction passage includes a first end portion which is constantly connected with the one of the hydraulic chambers; and the introduction passage includes a second end portion which is connected or disconnected with the control hydraulic chamber by an axial end surface of the cam ring.

(d) In the variable displacement pump according to the embodiments of the present invention, the introduction passage extends from the discharge portion's side toward the suction portion's side.

(e) In the variable displacement pump according to the embodiments of the present invention, the introduction passage includes a substantially linear portion extending toward the suction portion in an oblique direction with respect to protruding directions of the vanes.

Accordingly, it is possible to ensure the longer length of the introduction passage, and to improve the pressure decreasing effect by the introduction passage. With this, it is possible to slowly disappear the air bubbles generated within the hydraulic chambers. Therefore, it is possible to suppress the adverse effects such as the noise which are caused due to the disappearance of the air bubbles.

(f) In the variable displacement pump according to the embodiments of the present invention, the introduction passage is a groove having a width greater than a depth.

Accordingly, it is possible to act the discharge pressure within the control hydraulic chamber to the wider region of the hydraulic chambers, and to effectively disappear the air bubbles within the hydraulic chambers.

(g) In the variable displacement pump according to the embodiments of the present invention, the introduction passage is connected with a plurality of portions of the one of the hydraulic chambers.

Accordingly, it is possible to effectively disappear the air bubbles within the hydraulic chambers, and thereby to appropriately resolve the cavitation.

(h) In the variable displacement pump according to the embodiments of the present invention, the introduction passage is connected with a plurality of portions of the one of the hydraulic chambers in the circumferential direction.

Accordingly, it is possible to effectively disappear the air bubbles within the hydraulic chambers, and thereby to appropriately resolve the cavitation.

(i) In the variable displacement pump according to the embodiments of the present invention, the introduction passage has an area of an opening of a first end portion connected with the one of the hydraulic chambers which is greater than an area of an opening of a second end portion connected with the control hydraulic chamber.

Accordingly, it is possible to effectively disappear the air bubbles within the hydraulic chambers, and thereby to appropriately resolve the cavitation.

(j) In the variable displacement pump according to the embodiments of the present invention, the introduction passage includes a first end portion which is connected with the hydraulic chambers, and which is located nearer to the suction portion than to the discharge portion.

Accordingly, it is possible to introduce the discharge pressure to the hydraulic chambers in which the cavitation is prone to be generated, and thereby to effectively resolve the cavitation.

(k) In the variable displacement pump according to the embodiments of the present invention, the cam ring is held in a state where the eccentric amount of the cam ring is maximized when a rotational speed of the rotor is equal to or smaller than a first rotational speed, the cam ring is moved in a direction to decrease the eccentric amount of the cam ring until the rotational speed of the rotor is further increased to a second rotational speed, the cam ring is stopped until the rotational speed of the rotor is further increased to a third rotational speed, and the cam ring is moved in the direction to decrease the eccentric amount of the cam ring until the eccentric amount of the cam ring is minimized when the rotational speed of the rotor is further increased greater than the third rotational speed.

Accordingly, it is possible to decrease the driving torque of the pump by decreasing the useless discharge (amount) by varying the discharge amount in accordance with the rotational speed.

(l) In the variable displacement pump according to the embodiments of the present invention, the cam ring is arranged to receive an urging force of a second urging member in addition to the urging force of the urging member; and the cam ring is switched in accordance with the eccentric amount of the cam ring, between a state where the only urging force of the urging member is acted to the cam ring, and a state where both of the urging forces of the first urging member and the second urging member are acted to the cam ring.

Accordingly, it is possible to control the eccentric amount of the cam ring (the discharge amount of the pump) in the stepped manner, and thereby to further bring the discharge amount of the pump closer to the necessary hydraulic pressure of the engine. Therefore, it is possible to more effectively decrease the driving torque of the pump.

(m) In the variable displacement pump according to the embodiments of the present invention, the second urging member has the urging force acted in a direction opposite to the urging direction of the urging member.

(n) In the variable displacement pump according to the embodiments of the present invention, the introduction passage is arranged to connect the control hydraulic chamber and the one of the hydraulic chambers before the rotational speed of the rotor reaches the second rotational speed.

(o) In the variable displacement pump according to the embodiments of the present invention, the introduction passage is arranged to connect the control hydraulic chamber and the one of the hydraulic chambers in a rotational speed region lower than the third rotational speed.

(p) In the variable displacement pump according to the embodiments of the present invention, the introduction passage includes a first end portion which is connected with the one of the hydraulic chambers, and which is directly opened to the suction portion.

Accordingly, it is possible to ensure the longer length of the section in which the discharge pressure is acted to the air bubbles within the hydraulic chambers, and thereby to effectively disappear the air bubbles. Therefore, it is possible to effectively resolve the cavitation.

(q) In the variable displacement pump according to the embodiments of the present invention, the introduction passage includes a first end portion which is connected with the one of the hydraulic chambers, and which is opened to a portion which is on a downstream side of the suction portion in the rotation direction of the rotor.

Accordingly, it is possible to introduce the discharge pressure to the hydraulic chambers in which the cavitation is prone to be generated, and thereby to more effectively resolve the cavitation.

The entire contents of Japanese Patent Application No. 2011-162816 filed Jul. 26, 2011 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump comprising:

a rotor driven to rotate;

a plurality of vanes which are disposed at an outer circumference portion of the rotor, and each of which is arranged to be moved in a radially inward direction and in a radially outward direction of the rotor;

a cam ring which receives the rotor and the vanes therein, which separates a plurality of hydraulic chambers with the rotor and the vanes, and which is arranged to be moved to vary an eccentric amount of a center of an inner circumference surface of the cam ring with respect to a center of a rotation of the rotor, and thereby to increase or decrease volumes of the hydraulic chambers at the rotation of the rotor;

side walls provided on both sides of the cam ring in an axial direction, one of the side walls including a suction portion and a discharge portion, the suction portion being opened to the hydraulic chambers whose volumes are increased when the cam ring is moved in a direction to increase the eccentric amount of the cam ring, and the discharge portion being separated from the suction portion, in a direction of the rotation of the rotor by separation walls each having a circumferential width greater than a circumferential width of the hydraulic chambers, and which is opened to the hydraulic chambers whose volumes are decreased when the cam ring is moved in the direction to increase the eccentric amount of the cam ring;

an urging member arranged to urge the cam ring in the direction to increase the eccentric amount of the cam ring;

a control hydraulic chamber arranged to receive a discharge pressure, and generate a force with said discharge pressure to urge the cam ring in a direction to decrease the eccentric amount of the cam ring, against the urging force of the urging member; and an introduction passage, wherein the introduction passage is formed in one of the separation walls across which the hydraulic chambers pass over when the hydraulic chambers are moved from the suction portion to the discharge portion, wherein the introduction passage is arranged such that a connection between one of the hydraulic chambers and the control hydraulic chamber is shut off by an axial end surface of the cam ring when the cam ring is in a maximum eccentric state, and the one of the hydraulic chambers and the control hydraulic chamber is connected through the introduction passage by movement of the cam ring in the direction to decrease the eccentric amount of the cam ring, thereby introducing the discharge pressure within the control hydraulic chamber into the one of the hydraulic chambers.

2. The variable displacement pump as claimed in claim 1, wherein the cam ring is received within a housing constituting the side walls; and the control hydraulic chamber includes an outer circumference surface of the cam ring on the introduction passage side of the movement direction of the cam ring, and an inner side surface of the housing.

3. The variable displacement pump as claimed in claim 2, wherein the introduction passage is a groove formed in the one of the side walls.

4. The variable displacement pump as claimed in claim 3, wherein the introduction passage includes a first end portion which is constantly connected with the one of the hydraulic chambers; and the introduction passage includes a second end portion which is connected or disconnected with the control hydraulic chamber by the axial end surface of the cam ring.

5. The variable displacement pump as claimed in claim 3, wherein the introduction passage extends from the discharge portion's side toward the suction portion's side.

6. The variable displacement pump as claimed in claim 5, wherein the introduction passage includes a substantially linear portion extending toward the suction portion at an oblique angle with respect to protruding directions of the vanes.

7. The variable displacement pump as claimed in claim 2, wherein the introduction passage is a groove having a width greater than a depth of the grove.

8. The variable displacement pump as claimed in claim 1, wherein the introduction passage has an area of an opening at a first end portion connected with the one of the hydraulic chambers which is greater than an area of an opening at a second end portion connected with the control hydraulic chamber.

9. The variable displacement pump as claimed in claim 1, wherein the introduction passage includes a first end portion which is connected with the hydraulic chambers, and which is located nearer to the suction portion than to the discharge portion.

10. The variable displacement pump as claimed in claim 1, wherein the cam ring is held in a state where the eccentric amount of the cam ring is maximized when a rotational speed of the rotor is equal to or smaller than a first rotational speed, the cam ring is moved in a direction to decrease the eccentric amount of the cam ring until the rotational speed of the rotor is further increased to a second rotational speed, the cam ring is stopped until the rotational speed of the rotor is further increased to a third rotational speed, and the cam ring is moved in the direction to decrease the eccentric amount of the cam ring until the eccentric amount of the cam ring is minimized when the rotational speed of the rotor is further increased greater than the third rotational speed.

11. The variable displacement pump as claimed in claim 10, wherein the urging member is a first urging member the cam ring is arranged to receive an urging force of a second urging member in addition to the urging force of the urging member; and the cam ring is switched in accordance with the eccentric amount of the cam ring, between a state where the only urging force exerted by the first urging member acts on the cam ring, and a state where both urging forces of the first urging member and the second urging member are exerted onto the cam ring.

12. The variable displacement pump as claimed in claim 11, wherein the second urging member has the urging force exerted in a direction opposite to first urging member.

13. The variable displacement pump as claimed in claim 10, wherein the introduction passage is arranged to connect the control hydraulic chamber and the one of the hydraulic chambers before the rotational speed of the rotor reaches the second rotational speed.

14. The variable displacement pump as claimed in claim 13, wherein the introduction passage is arranged to connect the control hydraulic chamber and the one of the hydraulic chambers in a rotational speed region lower than the third rotational speed.

15. A variable displacement pump comprising:

a rotor driven to rotate;

a plurality of vanes which are disposed at an outer circumference portion of the rotor, and each of which is arranged to be moved in a radially inward direction and in a radially outward direction of the rotor;

a cam ring which receives the rotor and the vanes therein, which separates a plurality of hydraulic chambers with the rotor and the vanes, and which is arranged to be moved to vary an eccentric amount of a center of an inner circumference surface of the cam ring with respect to a center of a rotation of the rotor, and thereby to increase or decrease volumes of the hydraulic chambers at the rotation of the rotor;

side walls provided on both sides of the cam ring in an axial direction, one of the side walls including a suction portion and a discharge portion, the suction portion being opened to the hydraulic chambers whose volumes are increased when the cam ring is moved in a direction to increase the eccentric amount of the cam ring, and the discharge portion being separated from the suction portion, in a direction of the rotation of the rotor by separation walls each having a circumferential width greater than a circumferential width of the hydraulic chambers, and which is opened to the hydraulic chambers whose volumes are decreased when the cam ring is moved in the direction to increase the eccentric amount of the cam ring;

an urging member arranged to urge the cam ring in the direction to increase the eccentric amount of the cam ring;

a control hydraulic chamber arranged to receive a discharge pressure, and generate a force with said discharge pressure to urge the cam ring in a direction to decrease the eccentric amount of the cam ring, against the urging force of the urging member; and an introduction passage arranged to introduce the discharge pressure to at least one of the hydraulic chambers which is other than the hydraulic chambers that are opened to the discharge portion when the eccentric amount of the cam ring becomes equal to or greater than a predetermined amount, and arranged not to introduce the discharge pressure to the hydraulic chambers when the eccentric amount of the cam ring is maximized, wherein the introduction passage is formed in one of the separation walls across which the hydraulic chambers pass over when the hydraulic chambers are moved from the suction portion to the discharge portion, the introduction passage is arranged such that a connection between one of the hydraulic chambers and the control hydraulic chamber is shut off by an axial end surface of the cam ring when the cam ring is in a maximum eccentric state, and the one of the hydraulic chambers and the control hydraulic chamber is connected through the introduction passage by movement of the cam ring in the direction to decrease the eccentric amount of the cam ring, thereby introducing the discharge pressure within the control hydraulic chamber into the one of the hydraulic chambers.

16. The variable displacement pump as claimed in claim 15, wherein the introduction passage includes a first end portion which is connected with the one of the hydraulic chambers, and which is directly opened to the suction portion.

17. The variable displacement pump as claimed in claim 16, wherein the introduction passage includes a first end portion which is connected with the one of the hydraulic chambers, and which is opened to a portion which is on a downstream side of the suction portion in the rotation direction of the rotor.

* * * * *